US010246952B2

(12) United States Patent
Trydal et al.

(10) Patent No.: US 10,246,952 B2
(45) Date of Patent: Apr. 2, 2019

(54) METHOD FOR PLACING AND REMOVING PIPE FROM A FINGER RACK

(71) Applicant: NATIONAL OILWELL VARCO NORWAY AS, Kristiansand S (NO)

(72) Inventors: Stig Vidar Trydal, No (NO); Marianne Holmstrøm, Kristiansand S (NO); Kjell Rohde, Kristiansand (NO); Hugo Leonardo Rosano, Kristiansand (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 0 days.

(21) Appl. No.: 15/526,024

(22) PCT Filed: Nov. 13, 2015

(86) PCT No.: PCT/GB2015/053447
§ 371 (c)(1),
(2) Date: May 11, 2017

(87) PCT Pub. No.: WO2016/075478
PCT Pub. Date: May 19, 2016

(65) Prior Publication Data

US 2017/0306710 A1 Oct. 26, 2017

(30) Foreign Application Priority Data

Nov. 14, 2014 (GB) ..... 1420258.4

(51) Int. Cl.
*E21B 19/20* (2006.01)
*G06F 17/00* (2006.01)
(Continued)

(52) U.S. Cl.
CPC ..... *E21B 19/14* (2013.01); *G06K 9/78* (2013.01)

(58) Field of Classification Search
CPC ..... H04N 13/0203; H04N 7/18; H04N 5/225; B25J 19/023; F16P 3/142; G06K 9/78;
(Continued)

(56) References Cited

U.S. PATENT DOCUMENTS 4,959,802 A * 9/1990 Slaughter ..... G05D 1/0234 701/1
5,725,253 A * 3/1998 Salive ..... G09F 3/0297 235/375

(Continued)

OTHER PUBLICATIONS

International Search Report and Written Opinion dated Jan. 27, 2016 for international patent application No. PCT/GB2015/053447 filed on Nov. 13, 2015.

(Continued)

*Primary Examiner* — Gregory W Adams
(74) *Attorney, Agent, or Firm* — Amerson Law Firm, PLLC

(57) ABSTRACT

A system for placing and removing pipe from a finger rack of a drilling rig, the system comprising a pipe handling apparatus (140) and a finger rack (139) having at least one finger board (102) having at least two fingers (103 to 106) defining a slot (107 to 109) and a multiplicity of latches (114) arranged therebetween defining a space for a pipe, each latch (114) of the multiplicity of latches selectively movable between an open position and a closed position, the system further comprising at least one camera (101) having said at least one latch (114) of said multiplicity of latches in a field of view, capturing an image of said latch and sending said image to a master control computer (12'), said master computer control computer (12') programmed with a set of instructions to analyze said image for details indicative of the latch (114) being in an open position or closed position, concluding the latch (114) to be in an open position or closed position and allowing or disallowing a pipe handling appa-
(Continued)

ratus to place or remove a pipe in the finger rack (139) based on said conclusion.

27 Claims, 15 Drawing Sheets

(51) Int. Cl.
*G06K 9/46* (2006.01)
*E21B 19/14* (2006.01)
*G06K 9/78* (2006.01)

(58) Field of Classification Search
CPC ..... E21B 19/14; E21B 19/162; E21B 19/163; E21B 19/164; E21B 19/165; E21B 19/166; E21B 19/167; E21B 16/168
See application file for complete search history.

(56) References Cited

U.S. PATENT DOCUMENTS 7,270,277 B1 * 9/2007 Koziol ..... G06K 19/06037 235/494
2008/0173480 A1 7/2008 Annaiyappa et al.
2008/0282847 A1 11/2008 Halse
2009/0115929 A1 6/2009 Abdollahi et al.
2009/0210090 A1 * 8/2009 Takemitsu ..... B25J 9/1661 700/245
2010/0080417 A1 * 4/2010 Qureshi ..... G06K 9/00624 382/103
2012/0038848 A1 2/2012 Sinclair et al.
2013/0032405 A1 2/2013 Braxton
2013/0039541 A1 * 2/2013 Inazumi ..... G06T 5/003 382/103
2013/0275100 A1 * 10/2013 Ellis ..... H04N 13/0203 703/2
2013/0286192 A1 * 10/2013 Ramezanifard ..... G01N 1/08 348/135
2013/0345878 A1 12/2013 Austefjord et al.

OTHER PUBLICATIONS

UK Search Report dated Feb. 19, 2015 for GB application No. GB1420258.4 filed on Nov. 14, 2014.

* cited by examiner y
y
164
163
162
160
150
166
141
165
161
156
169
167
139
168
170
155
154
171
172
159
139
158
157
z
z

METHOD FOR PLACING AND REMOVING PIPE FROM A FINGER RACK

The present invention relates to a drilling rig and to a system, apparatus and method for placing and removing pipe from a finger rack of a drilling rig. Another aspect of the present invention also provides a system for monitoring the health of a multiplicity of latches of a finger board.

In the drilling of a wellbore a drill bit is arranged in a bottom hole assembly on the lower end of a drill string. The drill bit is rotated to bore a hole in a formation. The formation may be below water or may be dry land. An upper end of the drill string passes through an opening in a drill floor of a drilling rig. The opening is known as well centre. The drill string is constructed on a drilling rig and lowered into the hole using a wireline drawn-in and let-out by a winch known as a drawworks. The wireline passes over a crown block fixed to the top of a derrick, and passes down to a travelling block which travels up and down within the derrick to raise or lower joints of drill pipe and/or the entire drill string.

The drill bit is, at least initially, rotated by rotation of the drill string. The drill string may be rotated by a rotary table arranged at well centre in the drill floor. In this case, a swivel is a hooked on to the travelling block, which has an elevator attached thereto in which the drill string is held for lowering and raising. Alternatively or additionally, the drill string may be rotated by a top drive movable up and down a track in a derrick of the drilling rig. The travelling block is connected to a top drive to raise and lower the top drive along the track. A top drive elevator depends from the top drive on bails. As the hole is drilled, joints of drill pipe are added to the drill string to allow the drill bit to drill deeper into the formation. The joints of drill pipe are usually added in stands of two or more, usually three joints. The stands of drill pipe are made-up off well centre in a mouse hole or powered rat hole.

The drill pipe is initially kept horizontally in a hold of an off-shore rig or drill ship or in a horizontal stack on land. A joint of drill pipe is moved from the hold or stack on to a conveyor belt known as a catwalk, which conveys the joint of drill pipe up to the rig floor.

A first joint of drill pipe from the cat walk is picked up by a pipe handling apparatus and a pin end of the first joint lowered through a spider in the mouse hole. A second drill pipe is picked up from the cat walk and a pin end is hung above a box of the first joint of drill pipe. The pin of the second joint is rotated into the box of the first joint and torqued using an iron roughneck to make a two joint stand of drill pipe. A third and possibly fourth joint is added to build the stand of drill pipe. Another pipe handling apparatus moves the stand of drill pipe directly from the mouse hole or rat hole to well centre for connection to the drill string or into a finger rack comprising one or more finger boards for buffer storage. Each finger board comprises slots defined by steel beams known as fingers in an array, such a finger rack and pipe handling apparatus are disclosed in US-B2-8550761, the disclosure of which is incorporated herein for all purposes. A multiplicity of latches are arranged on each finger. A space is defined between adjacent fingers and adjacent latches for a single stand of drill pipe. A latch of the multiplicity of latches is arranged between each stand of drill pipe to inhibit the stand of drill pipe from toppling out of the slots. The latches are typically pneumatically operated and move between a horizontal and vertical position. A pipe handling arm is used to remove the stand of drill pipe from the finger boards to the well centre. The elevator or top drive elevator is used to lift the upper end of the stand of drill pipe, upon which the lower end swings into alignment with well centre. The stand of drill pipe is then connected to the string of drill pipe suspended in the hole. The connection is made using the same iron rough neck. A particular type of pipe handling apparatus is known as a column racker which comprises a column which can move in a track in front of the finger boards. The column has two or more pipe handling arms therealong and the column can rotate, giving access to large setback capacities of perhaps one to five hundred stands of drill pipe, casing and other pipes. The fingerboards accommodate pipes in an orderly fashion where they can be stored, secured and retrieved for stand building or drilling operations.

To retrieve a stand of drill pipe from a slot, the column racker will move in front of the selected slot, extend its gripper arms, open the corresponding latch or latches and then pull the stand out of the slot. The inverse operation is used when the column racker brings pipe into the fingerboard. Different latch types are used for drill pipe, casing production tubular etc. These vary in diameter, shape and weight. Latches are of various shapes. In addition, the distance between fingers within a fingerboard will vary. Latches have two main positions that are generally operated pneumatically. They can either be horizontal, as to prevent pipe from falling out of the slots; or vertical, freeing the way and allowing the pipe to be set or removed. Occasionally, the latches assume a position in between open and closed.

It is also know from WO 2011/135311 to have a system for determining the position of a downhole drill pipe relative to an iron roughneck. The system comprises: an imaging means arranged to capture an image of the drill pipe in a region of the pipe for engagement by the device; and a processor operable to analyse said captured image and to determine therefrom the position of the drill pipe relative to the iron roughneck. Also disclosed is a system comprising imaging means arranged to capture an image of drill pipe held in an elevator as a confirmation that the drill pipe is indeed therein.

The drill string is removed from the well, in a procedure known as "tripping-out". Typically, the top drive elevator lifts a stand length of drill pipe out of the hole. The spider in the rig floor at well centre prevents the rest of the drill string from falling downhole. The stand of drill pipe is disconnected from the drill string using an iron roughneck. The stand is "set-back" in the finger board. Thus when the entire drill string has been tripped out, a large number of stands of drill pipe are set-back in the finger boards.

To improve the integrity of the hole, the hole may be lined with casing. A string of casing is lowered into the hole and hung from a wellhead or template on the surface of the formation. During construction of the casing string a section of casing is added to the casing string as it is lowered into the hole. The section of casing is moved from a storage area directly to well centre, or using a finger rack as a buffer storage. Thus the finger board may additionally have fingers and latches at spacings suitable for casing, which is generally of a larger diameter than drill pipe. The section of casing is moved into alignment with well centre using a pipe handling apparatus or an elevator is used to lift the upper end from a conveyor so that the lower end swings into alignment with well centre and the casing string suspended in the hole. The section of casing is then connected to the string of casing suspended in the hole.

Before drilling continues, the drill bit and drill string are "tripped-in" to the well. The drill bit on a BHA and subsequently stands of drill pipe from the finger boards are moved to well centre one at a time using the pipe handling arm and connected in the same procedure as described above, except for the fact that the hole is pre-drilled and cased, so the procedure is carried out at a much quicker pace than when drilling.

Other downhole tools may be placed in a finger rack, such as mud motors, whipstocks, liner, production tubular, wellbore cleaning tools etc.

The inventors have observed that there is a risk of drill pipe, casing and other pipes and downhole tools set back in a finger board of a finger rack from toppling out. The inventors have also observed that there are many hundreds of latches in a finger board. Although the probability of failure of a latch is low, because of the large number of latches, the probability is not insignificant. In the event that a latch fails to open or only partially opens, a pipe handling arm may still try to pull the stand out of the finger board, which could lead to equipment damage and possibly dropped parts or even a dropped pipe. In the event that a latch fails to close, the pipe being placed in the finger rack may topple out. The inventors have also noted that the latches need to be checked regularly. Latches operate in open loop and when a mechanical failure occurs it is not possible with existing systems to detect if the latch successfully changed position. Cost and time consequences vary depending on how quickly an operator can detect it on its own. Nonetheless, it is a hazard for the equipment, structure and personnel nearby whenever a column racker pulls or pushes against a defective latch. The inventors have also observed that drilling rigs are operated in daytime and at night, in normal and extreme weather conditions, such as off-shore in the arctic circle, snow bound conditions on land, icy conditions, as well as in hot deserts with blinding light.

In accordance with the present invention there is provided a system for placing and removing pipe from a finger board of a drilling rig, the system comprising a drilling rig having a rig floor, a derrick, a pipe handling apparatus and at least one finger board having at least two fingers defining a slot and a multiplicity of latches arranged therebetween defining a space for a pipe, each latch of the multiplicity of latches selectively movable between an open position and a closed position, the system further comprising at least one camera having at least one latch of said multiplicity of latches in a field of view, capturing an image of said latch and sending said image to a master control computer, said master computer control computer programmed with a set of instructions to analyse said image for details indicative of the latch being in an open position or closed position, concluding the latch to be in an open position or closed position and allowing or disallowing a pipe handling apparatus to place or remove a pipe in the finger board based on said conclusion.

The present invention also provides a drilling rig having a rig floor, a derrick, a pipe handling apparatus and at least one finger board having at least two fingers defining a slot and a multiplicity of latches arranged therebetween defining a space for a pipe, each latch of the multiplicity of latches selectively movable between an open position and a closed position, the drilling rig further comprising at least one camera having at least one latch of said multiplicity of latches in a field of view. The at least one camera for capturing an image of said latch and sending said image to a master control computer, said master computer control computer programmed with a set of instructions to analyse said image for details indicative of the latch being in an open position or closed position, concluding the latch to be in an open position or closed position and allowing or disallowing a pipe handling apparatus to place or remove a pipe in the finger board based on said conclusion.

The present invention also provides a method for placing and removing pipe from a finger board of a drilling rig comprising a rig floor, a derrick, a pipe handling apparatus and at least one finger board having at least two fingers defining a slot and a multiplicity of latches arranged therebetween defining a space for a pipe, each latch of the multiplicity of latches selectively movable between an open position and a closed position, and further comprising at least one camera having at least one latch of said multiplicity of latches in a field of view, the method comprising the steps of capturing an image of said latch and sending said image to a master control computer, said master computer control computer programmed with a set of instructions to analyse said image for details indicative of the latch being in an open position or closed position, concluding the latch to be in an open position or closed position and allowing or disallowing a pipe handling apparatus to place or remove a pipe in the finger board based on said conclusion.

Optionally, the system and method also concludes if the latch is in a partially open, intermediate position.

Optionally, the camera is a high definition analogue or digital cctv camera which captures the image. The cctv camera may be of the type including a charge coupled device (ccd) or complementary metal-oxide-semiconductor (cmos). Optionally, the camera comprises a colour imaging sensor. Optionally, the sensor can also detect infrared frequency range. Alternatively, the camera further comprises an infrared sensor, using an infrared marker located on the each latch. Optionally, the infrared marker is passive i.e. not powered. Optionally, the camera is a range imaging camera to capture the image and distances to objects captured in the image. Optionally, the range imaging camera is a time-of-flight range imaging camera, which optionally uses a laser to flood the field of view with laser light and measures the time it takes to send and receive a reflection of the light to build a range image. Optionally, the range imaging camera is a stereo range imaging camera, which optionally uses two cameras aimed at the same object to provide range measurements. Optionally, the range imaging camera is of a sheet of light triangulation type or a structured light type.

Optionally, the camera is arranged in a housing with a glass or the translucent or transparent window provided with wipers, such as wiper blades to keep the window clean and clear of rain, snow, water spots, dust and dirt. Optionally, the camera is provided with the light source to keep the light intensity at the latch of at least 350 LUX. Optionally, the light source is mounted next to the camera.

Optionally, the camera is arranged on the pipe handling apparatus, optionally the handling apparatus comprises a handling arm with a pipe gripping apparatus for gripping a pipe, and a base fixed to a column, the camera arranged on or under said base or alternatively on said gripping apparatus. Optionally, the camera is located on or in a fixed relation to a column of the pipe handling apparatus. Optionally, the column is moveable in a horizontal plane and optionally, rotatable. Optionally, the camera is arranged on said derrick in front of said finger board. Optionally, a camera is arranged at the back and above the plane of the finger board. Optionally, the camera is arranged on a track. Optionally, the track is substantially perpendicular to the fingers. Optionally, the camera has a union joint base, so that the camera can change its field of vision, optionally with a control system. If the field of vision of the camera is not quite right to capture a good image, the orientation in two or three degrees of rotational freedom may be made. Alternatively, a turn table allowing one degree of rotational freedom is used. Alternatively the camera is fixed so that no movement can occur.

Optionally, the pipe handling apparatus is a pipe handling arm. Optionally, the pipe handling arm is controlled by a pipe handling arm computer. Optionally, the pipe handling arm computer is programmed with a set of instructions to find a pipe in said finger board, to remove the pipe from the finger board and to convey the tubular to well centre.

Optionally, the pipe is one of: a stand of drill pipe; a section of drill pipe; a section of casing; a stand of drill pipe having a downhole tool therein or connected thereto; a Bottom Hole Assembly or part thereof; production tubular; liner; and perforate pipe.

Optionally, the step of analysing the image for details indicative of the latch being in an open position or closed position comprises analysing a contrast about said latch. Optionally, an outline is mapped about the latch, optionally other features of the latch, such as the pattern of holes therein. Optionally, the detail indicative of the latch being in an open position or closed position comprises analysing the area in which the latch should not be in the an open position or closed position i.e. looking for a missing latch lying in a horizontal plane when the latch should be in an open position.

Optionally, the system further comprises a step of defining a sub-image of an area about one latch.

Optionally, the sub-image covers an area sufficient to cover the one latch in a closed and open position.

Optionally, the master control computer comprises an algorithm to look for ellipses or circles on a latch. Optionally, to assess if the latch is closed. Optionally, to look for a set of ellipses in a line and optionally, in a horizontal line.

Optionally, the latch comprises a marker. Optionally, the marker has a reflective element. Optionally the marker is a reflective tape. Optionally, reflecting visible light or light of a wavelength which the camera can detect, which may include infrared light. Optionally, the master control computer comprises an algorithm to look for the marker on the latch. Optionally, the master control system is provided with a further algorithm to look for an outline of the latch and compare the relative position of the marker with the outline of the latch. Optionally, to assess if the latch is open.

Optionally, the camera captures an image of the slot in the finger rack and the master control computer comprises an algorithm to look for an unregistered pipe and ghost pipe. An unregistered pipe is a pipe which is there in reality but is not registered in the computer system. A ghost pipe is a pipe which is registered in the computer system but does not actually exist in reality. Optionally, prior to checking the status of the latches. The algorithm for checking for unregistered pipe or ghost pipe may comprise a databank of images of pipe in particular slots and between particular latches and comparing the image with the databank. Alternatively, the algorithm can determine that the image contains a pipe by noting certain features, such as a colour contrast in the outline of the pipe.

It is important to check for unregistered pipe and ghost pipe. In a worst case scenario, pipe could be dropped on the rig floor. Furthermore, damage to the pipe handler and other equipment may occur. Time delays also occur if equipment, such as the pipe handler thinks it has completed a handling procedure, when it hasn't.

Optionally, the pipe handling apparatus is controlled by a pipe handling control computer, programmed with a set of instructions to find a pipe in said finger board, to remove the pipe from the finger board and to convey the tubular to well centre. The master control computer instructing said pipe handling computer to allow or disallowing the pipe handling apparatus to place or remove a pipe in the finger rack based on said conclusion as to whether the latch is in an open or closed position.

Optionally, at least one further image of the latch is obtained from said camera after said image, said at least one further image processed by the master computer control computer programmed with a set of instructions to analyse said at least one further image for details indicative of the latch being in an open position or closed position, to confirm or deny said conclusion. Optionally, to increase the robustness and certainty of the conclusion. Optionally, said image is digital, although may be an analogue image. Optionally, said image comprises or is wholly built up from range data, such that a three dimensional image is captured and sent to the master computer system. Optionally, the range data is measured for each one to one thousand square millimeters, optionally every ten to one hundred square millimeters of the zone.

Optionally, the image is captured and processed in real time. Optionally, the and further image are captured within 0.01 and five seconds of one another.

Optionally, the master computer system is located in the at least one camera or housing thereof. Alternatively, the master computer system is located on the drilling rig, such as in a dog house. Alternatively, the master computer system is located at a distance to the drilling rig, such as in a control centre or in the cloud.

Optionally, the rig floor is located in a drilling rig. Optionally, the rig floor is locate in one of: a drill ship; FPSO; SWATH; tensioned leg platform; and land rig.

These and other needs in the art are addressed by an integrated non-contact measuring equipment. In a preferred embodiment, the measuring system comprises one or more cameras located at the column racker. The camera is located in a fixed position that allows an obstructed view of the latches to be operated. A series of images are collected and processed for the identification of expected geometries and feature compositions. Data obtained from the images are mapped into a three dimensional representation of the finger and latches in front of the column racker at the time. A minimum of one image is required; however more are combined to increase the robustness and certainty of the results.

In another embodiment, an articulated mount for the camera is activated based on desired views and positioning of other movable components on the column racker. The articulated mount will go to predefined positions according to the finger configuration the column racker will face at the time. Some models and/or fingerboard configurations would not require additional degrees of freedom.

Other needs in the art are addressed in another embodiment by a dedicated movable track with one or more cameras mounted on it on the opposite side of the fingerboard, behind the setback facing the column racker. An additional integrated actuator will move the camera from one finger to the next, scanning the state of all latches using the same image processing technique.

In a particular embodiment a non-contact range sensor is used in addition or in substitution to the image-based recognition system. The sensor comprises a laser or sonar for the creation of a three dimensional representation of the equipment state in front on the column racker.

The present invention also provides a system for monitoring the health of a multiplicity of latches in a finger board of a drilling rig, the system comprising a drilling rig having a rig floor, a derrick, a pipe handling apparatus and at least one finger board having at least two fingers defining a slot and a multiplicity of latches arranged therebetween defining a space for a pipe, each latch of the multiplicity of latches selectively movable between an open position and a closed position and a latch controller for controlling said latches between the open position and the closed position, the system further comprising at least one camera having at least one latch of said multiplicity of latches in a field of view, capturing an image of said latch and sending said image to a master control computer, said master computer control computer programmed with a set of instructions to analyse said image for details indicative of the latch being in an open position or closed position, concluding the latch to be in an open position or closed position, the master control computer receiving an information data packet from the latch controller, the information data packet comprising information as to said latch be in an open position or closed position, the master computer performing a comparison of the information in said information data packet with the conclusion obtained from the camera and assessing the health of the at least one latch based on said comparison.

Optionally, the latch controller is incorporated into a pipe handling computer. Optionally, if the assessment of the health of the latch is unhealthy, further comprising the step of the master computer sending a message to a display indicating that the at least one latch is unhealthy. Optionally, if the assessment of the health of the latch is unhealthy, further comprising the step of the master computer sending a message to the supplier of the latch at a remote location, the contractor for servicing the latch at a remote location or a technician on the drilling rig. The message may be in the form of an automatically generated email, generated by the master control system with information concerning the serial number of the latch, a copy of the image and details of the finger board such as installed height and serial number and details of the drilling rig, which information is pre-stored in a memory of the master control computer.

WO 2004/044695 discloses a computer system used in checking the health of various parts of a drilling rig.

For a better understanding of the present invention, reference will now be made, by way of example, to the accompanying drawings, in which.

Figure 1:
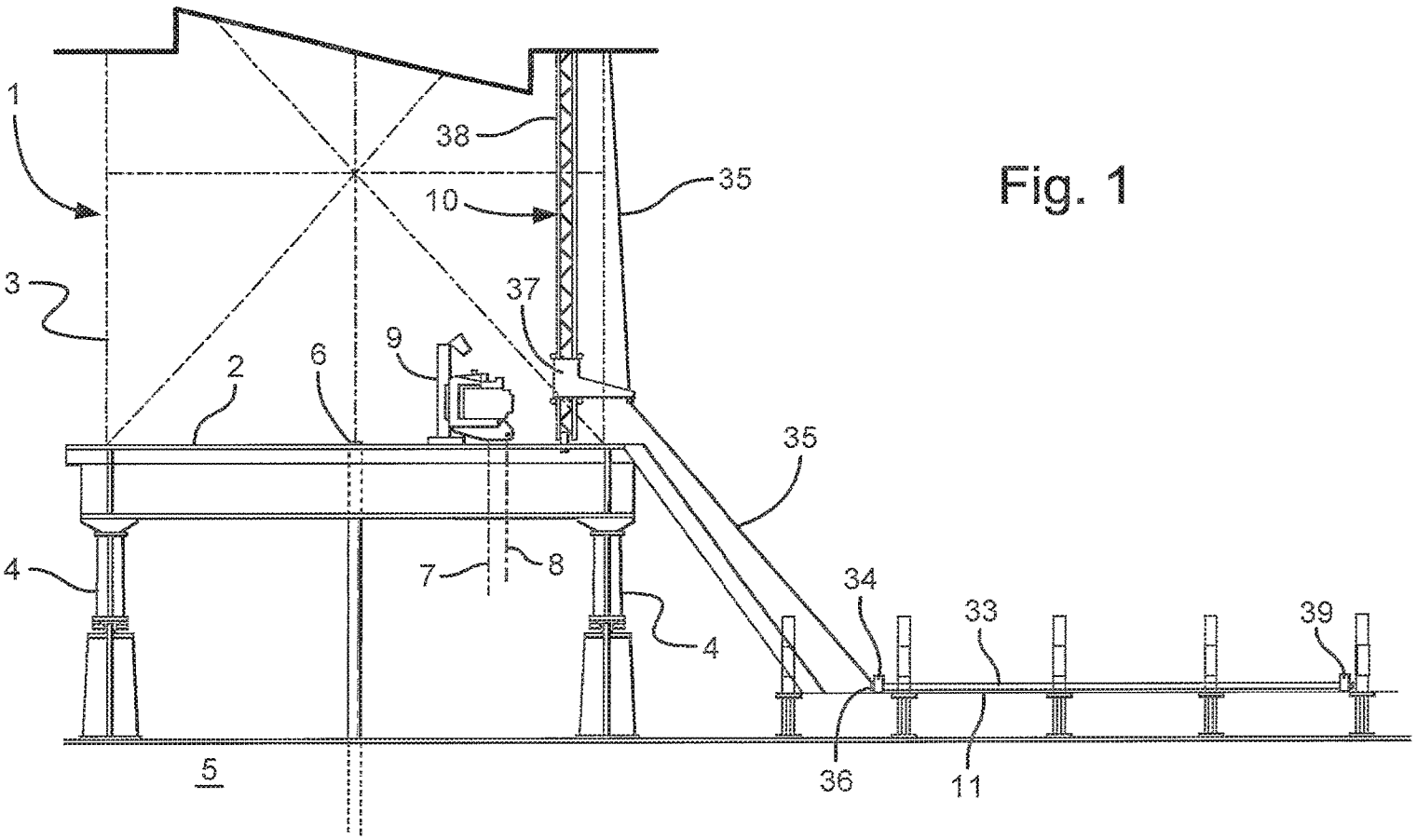
FIG. 1 is a side view of part of a drilling rig in accordance with the present invention having a rig floor.
Figure 2:
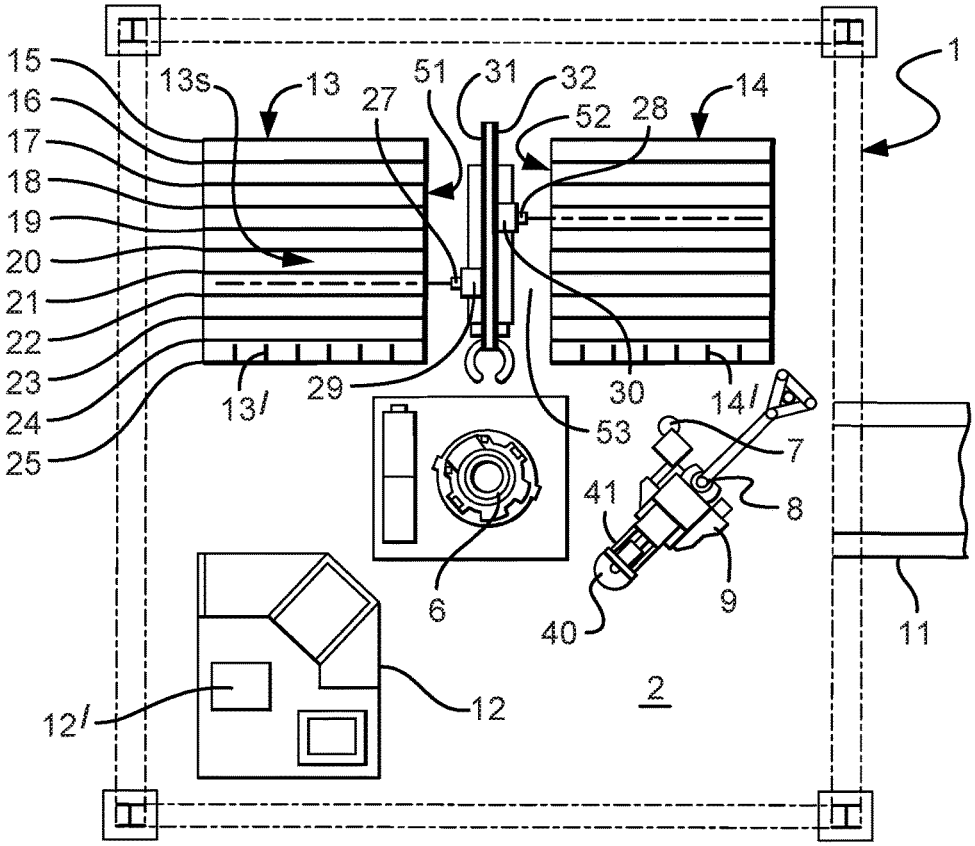
FIG. 2 is a top plan schematic view of the rig floor shown in FIG. 1, in a first step of operation with parts removed for clarity.
Figure 3:
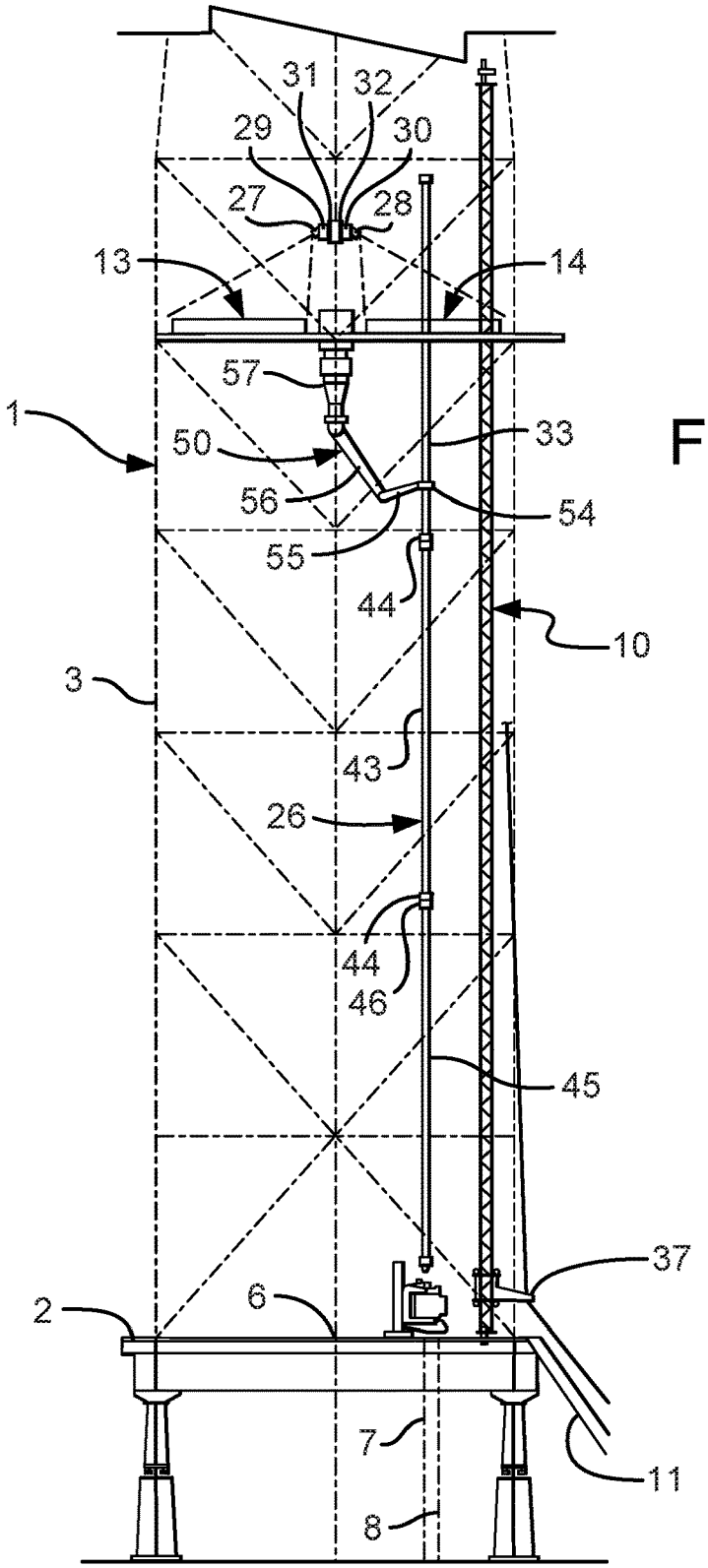
FIG. 3 is a side view of the drilling rig shown in FIG. 1, in a further step of operation.

Referring to FIGS. 1 to 3, there is shown part of a drilling rig, generally identified by reference numeral 1 having a rig floor 2 and a derrick 3. The rig floor 2 is supported on legs 4 on ground 5. The rig floor 2 has a well centre 6 and mouse holes 7 and 8. An iron roughneck 9 and drill pipe handler 10 are arranged adjacent the mouse holes 7 and 8. A catwalk 11 is arranged between the ground 5 and rig floor 2 adjacent the drill pipe handler 10.

A dog house 12 is arranged on one corner of the rig floor 2, which is typically a control room for the driller and/or tool pusher.

Two finger boards 13 and 14 are fixed in the derrick 3 approximately twenty-five meters above the rig floor 2. Finger board 13 has eleven fingers 15 to 25. Each finger 15 to 25 has six latches 13' (only shown in finger 25) are arranged between adjacent fingers to provide storage for sixty stands of drill pipe 26. Similarly finger board 14 is able to store sixty stands of drill pipe 26. A camera 27 and 28 are each fixed on a carriage 29 and 30. The carriage 29 and 30 is movably arranged along horizontal track 31 and 32 along a path in front of the respective finger board 13 and 14.

A pipe handling arm 50 is arranged in a gap 53 between fronts 51 and 52 of the finger boards 13 and 14. The pipe handling arm 50 has a pipe gripper 54, a first arm 55 pivot ally connected to the pipe gripper 54, a second arm 56 pivotally connected to the first arm 55, and a base 57 having a turntable with the second arm 56 pivotally connected thereto to allow a further degree of freedom.

In use, a first joint of drill pipe 33 is moved from a pipe supply rack or pile arranged on the ground 5 on to the catwalk 11. A pipe elevator 34 of pipe handler 10 depends from a line 35 and is placed about a box end 36 of the drill pipe 34. The line 35 is drawn in on a winch (not shown) to pull the first joint 33 up the catwalk 11 until it reaches a carriage 37 on a column 38 of the pipe handler 10. The winch (not shown) carries on drawing in the line 35, moving the carriage 37 up the column 38 until the lower pin end 39 of the first joint 33 is clear above the rig floor 2. The carriage 37 is rotated about column 38 into vertical alignment with mouse hole 8. The winch (not shown) is reversed to lower carriage 37, lowering the joint 33 into mouse hole 8. A spider (not shown) at mousehole 8 may be used to prevent the joint from falling through the rig floor 2 or a shoe (not shown) in the ground 5 could be used. The pipe elevator 34 is disconnected from the first joint 33 and returned to the position shown in FIG. 1. A second joint is moved from the pipe supply rack or pile in the same way and swung about column 38 into alignment with mouse hole 6. The iron roughneck 9 is swung about an iron roughneck column 40 and extended on an arm 41 to engage the first joint 33 and second joint 43. The iron roughneck 9 spins a pin end 44 of second joint 43 into box end 36 of the first joint 33 and then torques the connection. A third joint 45 is placed in mouse hole 7, and the connected joints 33 and 43 are lifted by elevator 34 and swung into alignment with mouse hole 7 and the pin end 39 of the first joint 33 lowered into a box end 46 of the third joint and a connection made there between with the iron roughneck 9 to form a stand 26 of three joints of drill pipe 33, 43 and 45.

The stand 26 is picked by the pipe gripper 54 of the pipe handling arm 50 and placed between adjacent fingers 15 to 25 of finger board 13 or 14, details of which will now be described.

Each Camera 27 and 28 is arranged in front of and above each finger board 13 and 14 respectively to obtain a good view of the latches in an open position in which a pipe can be inserted and removed and a closed position in which the pipe is restrained from removal from the finger board 13 and 14. Each camera 27 and 28 is arranged on a respective carriage 29 and 30 movably arranged on a track 31 and 32. Each track 31 and 32 lies perpendicular to the fingers 15 to 25 such that each camera 27 and 28 on respective carriage 29 and 30 moves along respective track 31 and 32 to obtain a field of view along each finger 15 to 25.

In use, the pipe handling arm 50 is controlled by an operator in a control room following a set of steps or by a master control computer 12' following a set of preprogrammed steps to set-back a stand of drill pipe 26 in the finger board 13. The steps comprise the pipe handling arm 50 activated to move the pipe gripper 54 to engage the stand of drill pipe 26 located in the mouse hole 7. The pipe gripper 54 is activated to grip the stand of drill pipe 26. Rollers (not shown) in the pipe gripper 54 are activated to lift the stand of drill pipe out of the mouse hole 7 clear of the rig floor 2, if required. The pipe gripper 54 is then moved to a predetermined position in front of the finger board 13, for example in front of a slot 13*s* defined by fingers 20 and 21. The master control computer automatically activates certain of the latch assemblies arranged between fingers 20 and 21 to move to an open position to allow the stand of drill pipe 26 to enter the slot 13*s*. The master control computer also controls carriage 29 to move camera 27 along track 31 to a position directly in front of the slot defined by fingers 20 and 21. The camera 27 is controlled by the master control computer 12' to capture at least one image of the latch assemblies along slot 13*s*. A representation of the image captured by camera 27. The master control computer 12' analyses the at least one image and determines if all of the relevant latches are in the image. This may be carried out by comparing the image with a preloaded known image. The master control computer also assesses which of the latches 13' should be open and which should be in a closed position. The master control computer compares the images to those of open and closed preloaded images and looks for indications, such as a contrast in colour around features such as around the latch 13' when in a horizontal and vertical positions or for other features of the latch when in open and closed positions such as holes in the latch 13'. The camera 27 may be provided with its own light source directed on the cameras field of view to improve such a contrast. Once the master control computer has established if the latch is in an open position or a closed position, the master control computer 12' allows or disallows the pipe handling apparatus 50 to move the stand of drill pipe 26 to enter the slot 13*s* provided in between fingers 20 and 21 on the pipe handling arm 50.

Figure 5:
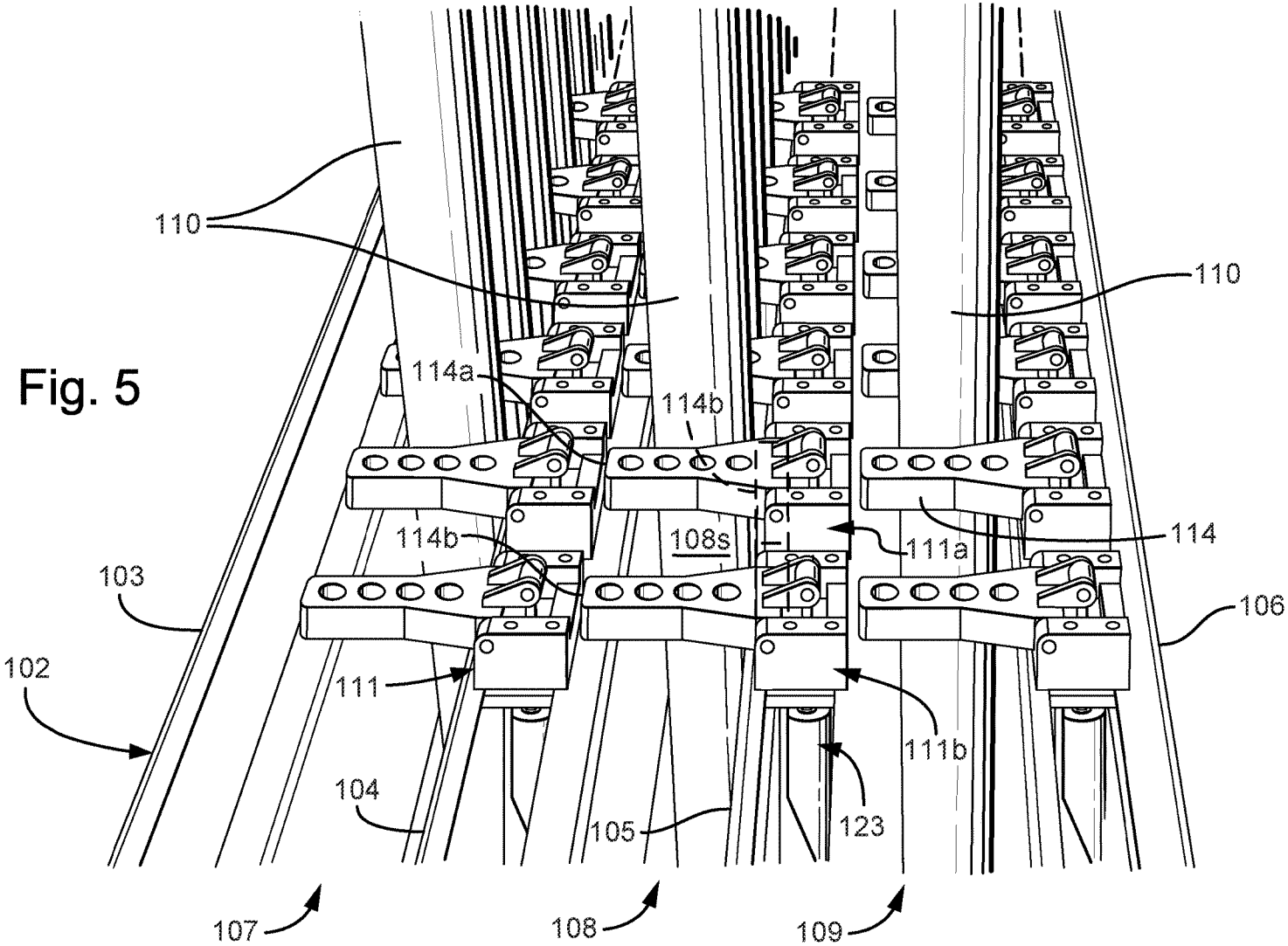
FIG. 5 is a perspective view of the finger board shown in FIG. 4 taken from the point of view of the camera in a second stage of operation with a multiplicity of stands of drill pipe.
Figure 6:
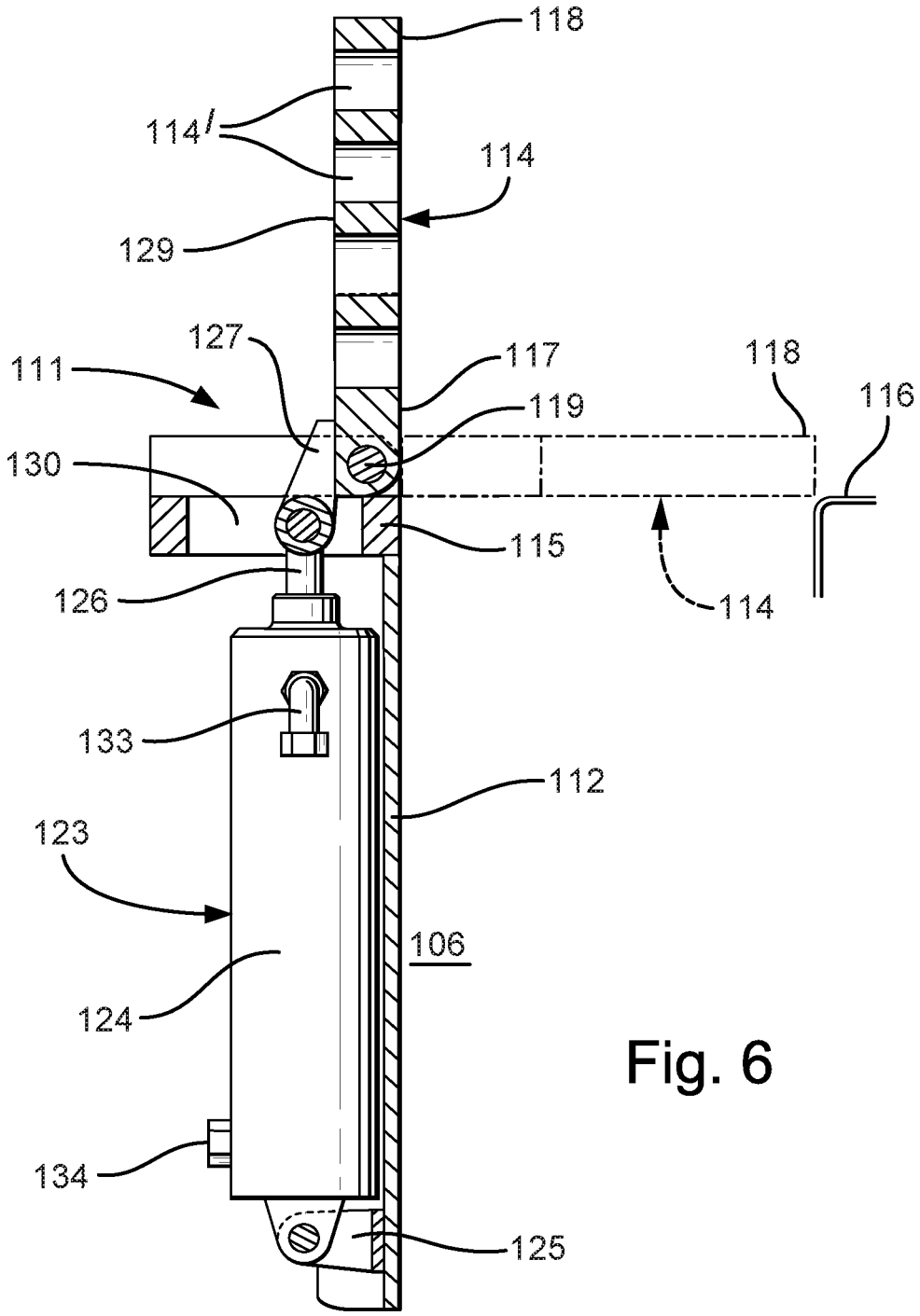
FIG. 6 is a side view of a latch in a finger of the finger board taken along line VI-VI of FIG. 4 in an open position with dotted lines showing a closed position.
Figure 7A:
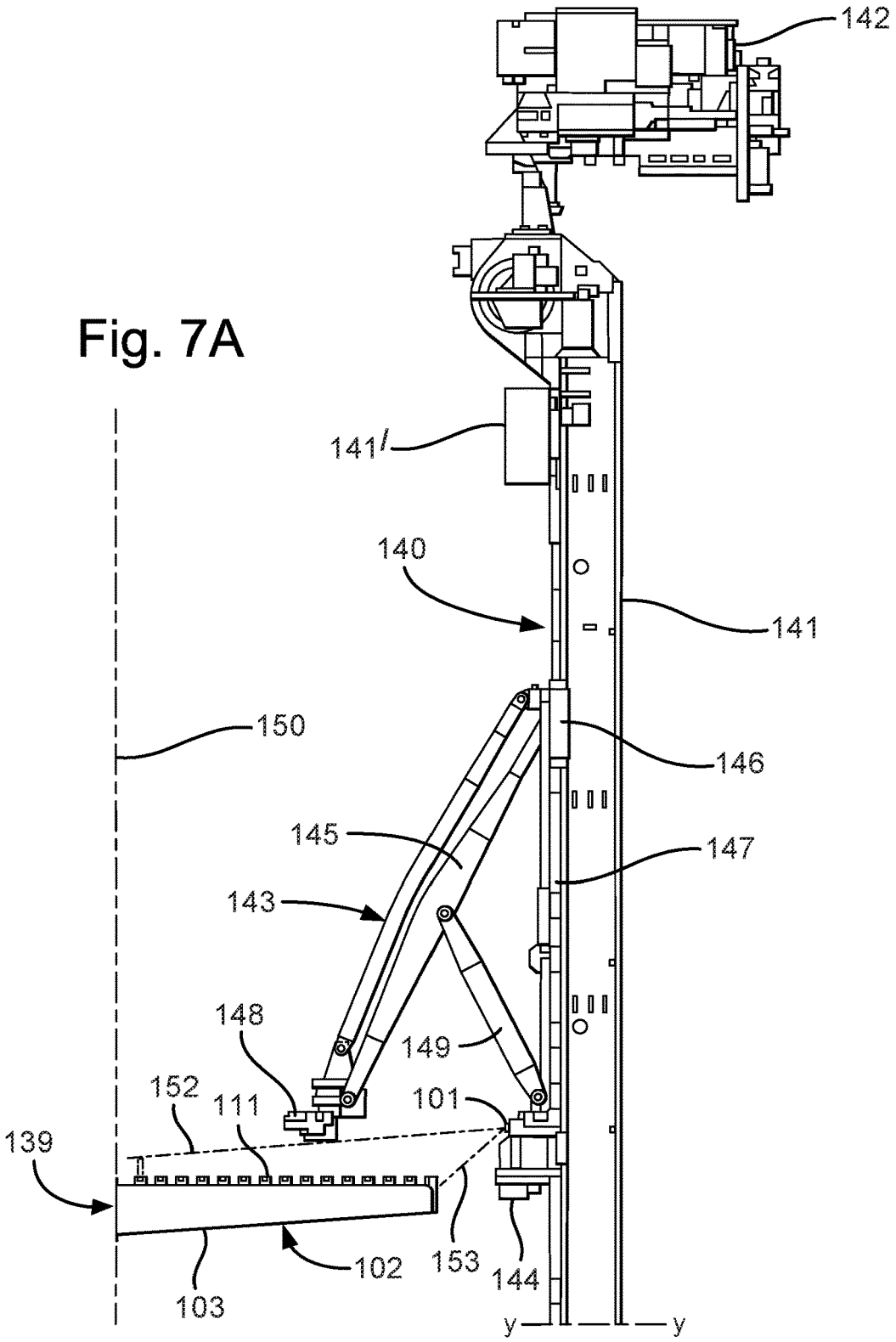
FIGS. 7A, 7B and 7C show a side view of the finger board shown in FIG. 4 in a derrick with a pipe handling apparatus in accordance with the present invention for use on an offshore drilling rig, without stands of drill pipe therein.

A second embodiment of the invention is shown in FIGS. 4 to 7C in which a camera 101 is fixed in a part of a pipe handling apparatus 140 shown in FIG. 7A above and in front of a finger board 102. Four fingers 103 to 106 lie parallel to one another defining three slots 107, 108 and 109 to receive stands of drill pipe 110. Each finger 103 is constructed from a box section steel girder having latch assemblies 111 on a ledge 112 on a first side 113 on to which a hinge plate 115 of the latch assembly 111 is fixed. The latch assembly 111 is shown in more detail in FIG. 6. A latch 114 is pinned at a first enlarged proximal end 117 to the hinge plate 115 with a hinge pin 119 and a narrowed distal end 118 moves in a ninety degree arc about the hinge pin 119. The depth of the latches 114 is substantially constant, such that in side view the latch 114 is a rectangle. The latch 114 has a number of holes 114' extending through the latch 114 from front to back which form a pattern. When the latch 114 is in a closed position, the distal end 118 of the latch 114 may rest on or lie adjacent to a ledge 116 of a second side 121 of the fingers 103 to 106. A double acting pneumatic ram 123 has a cylinder 124 with lower end rotatably hinged to a lug 125. The lug 125 is welded to finger 106. The ram 123 also has a piston 126 which passes through opening 130 in hinge plate 115. The piston 126 is rotatably pinned between latch lugs 127. The latch lugs 127 are welded or otherwise fixed or formed integrally with an upper face 129 of the enlarged proximal end 117 of the latch 114. Pneumatic supply nipples 133 and 134 are provided to facilitate a pneumatic connection to a supply of pneumatic fluid (not shown) through control valves (not shown). In use, when the piston 126 is extended under a supply of pneumatic fluid under pressure through nipple 134, the latch 114 moves along the arc about hinge pin 119 into the closed position. In use, when the piston 126 is retracted under a supply of pneumatic fluid under pressure through nipple 133, the latch 114 moves along the arc about hinge pin 119 into the open position.

Figure 7B:
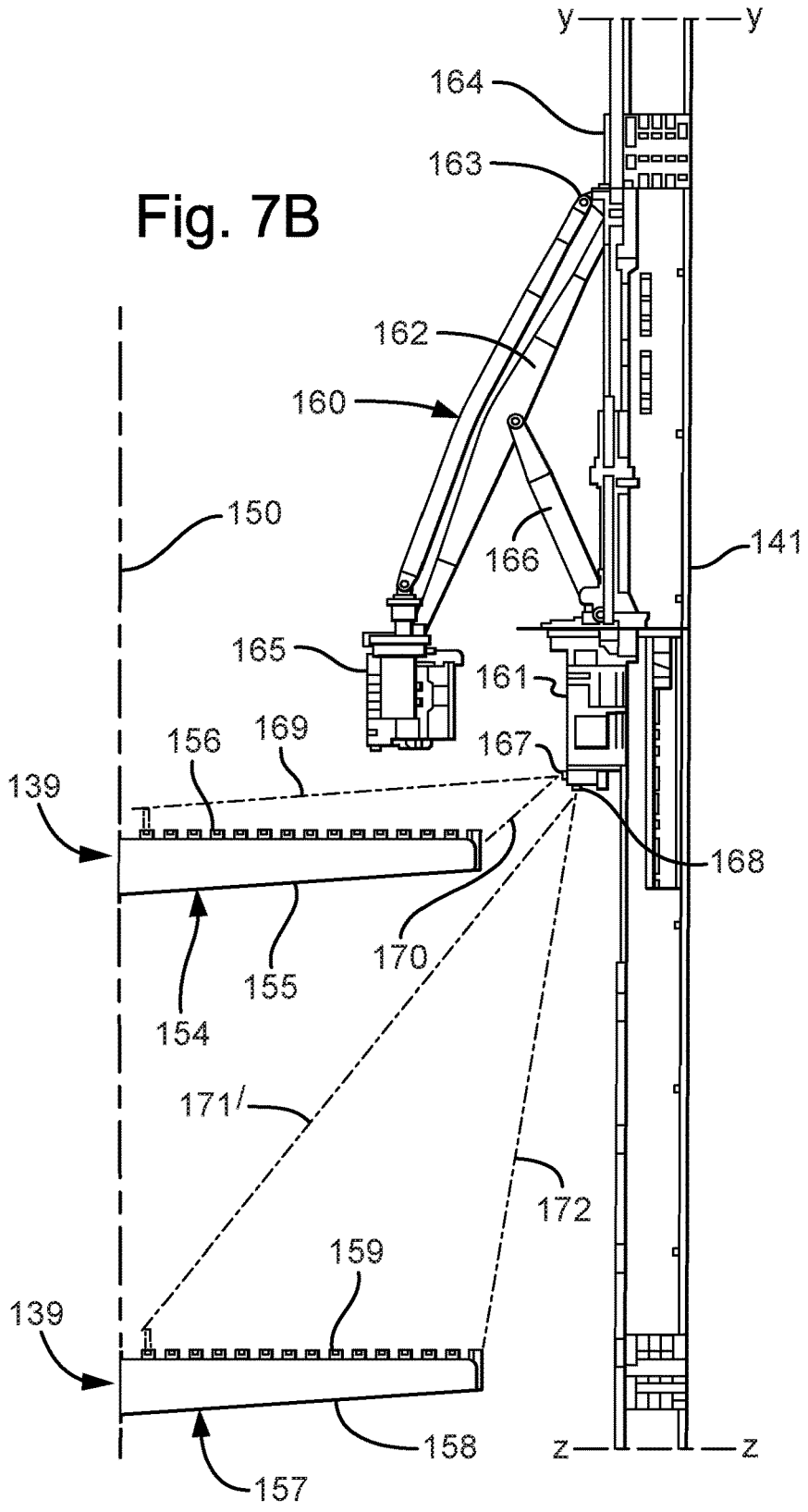
Figure 7C:
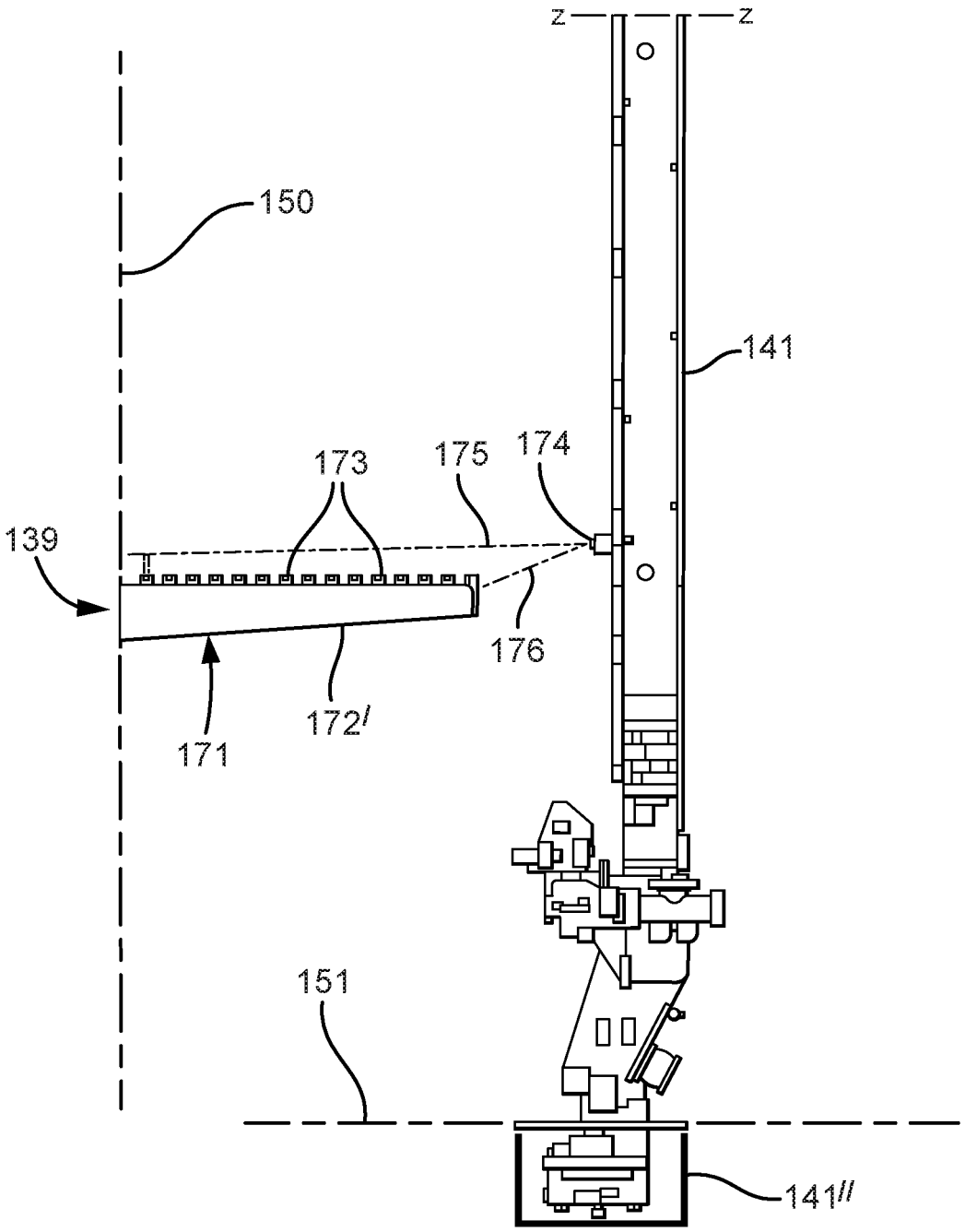
Figure 8:
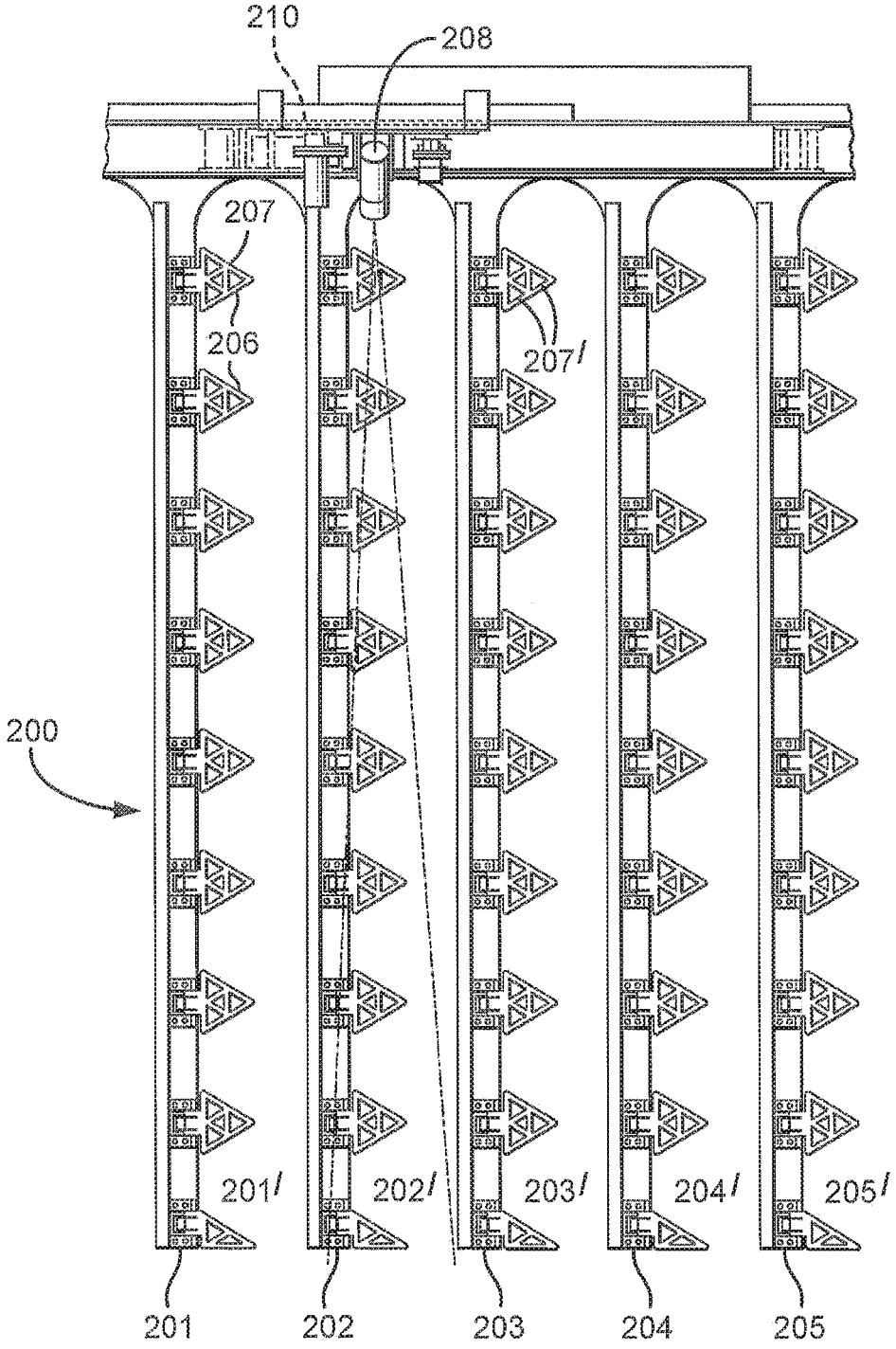
FIG. 8 is a top plan schematic view of a third embodiment of an apparatus in accordance with the present invention.
Figure 9:
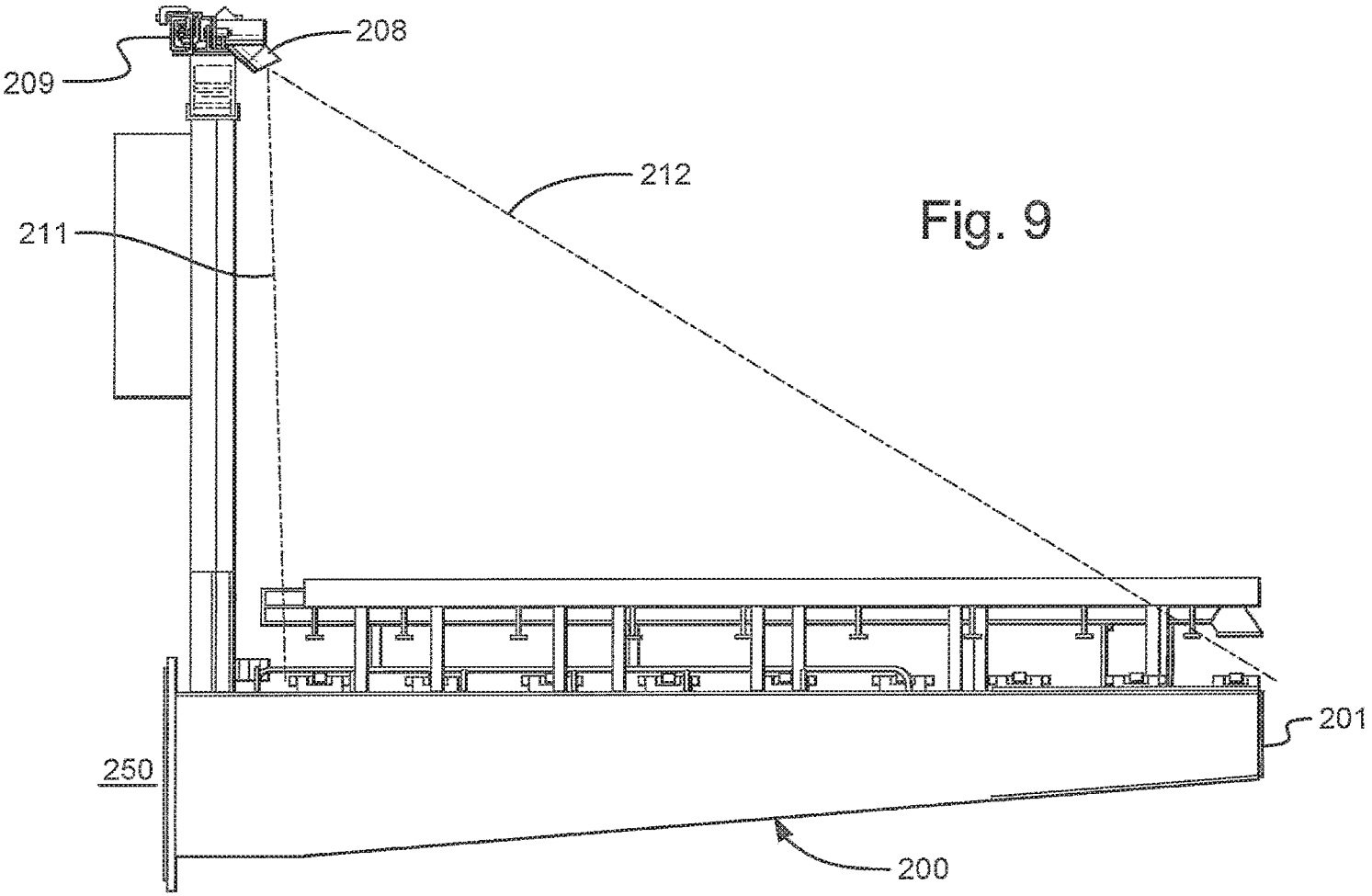
FIG. 9 is a side schematic view of the apparatus shown in FIG. 8.
Figure 10:
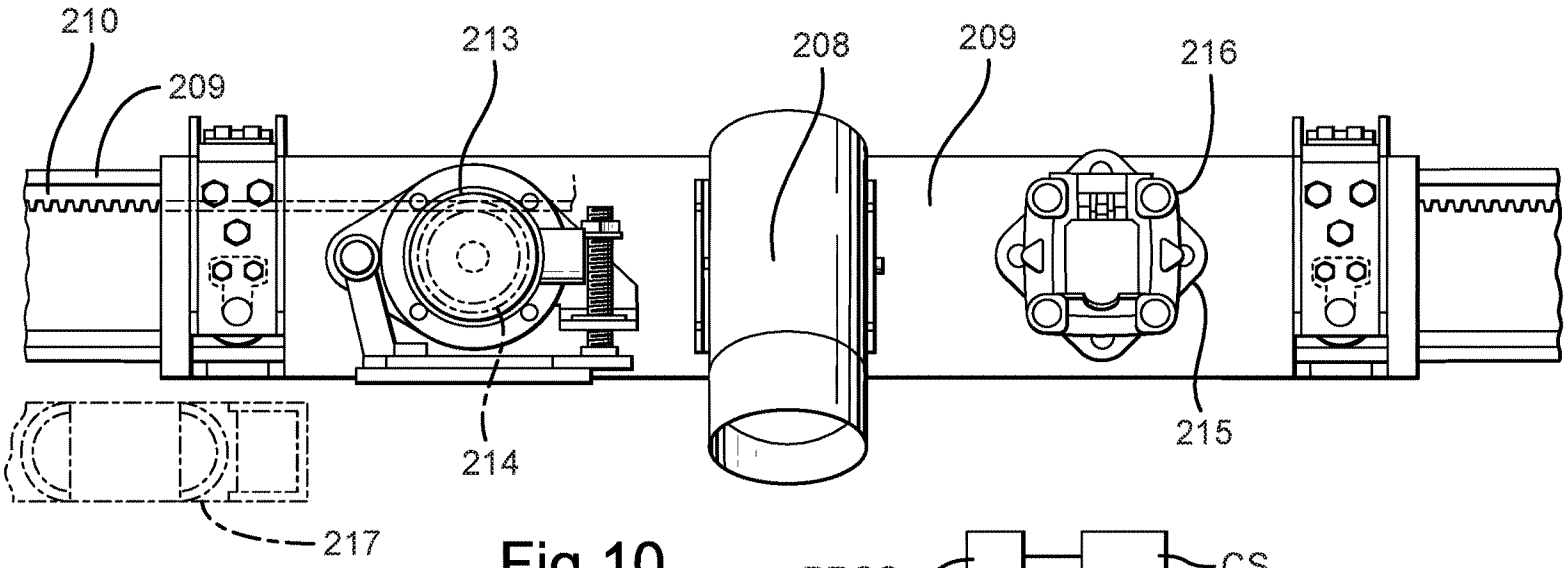
FIG. 10 is an enlarged front schematic view of part of the apparatus shown in FIG. 8.

A pipe handling apparatus 140, known as a column racker and a finger rack 139 are shown in FIGS. 7A to 7C in accordance with the present invention. The finger rack 139 comprises four finger boards 102, 154, 157, 171 in vertical alignment.

Figure 5A:
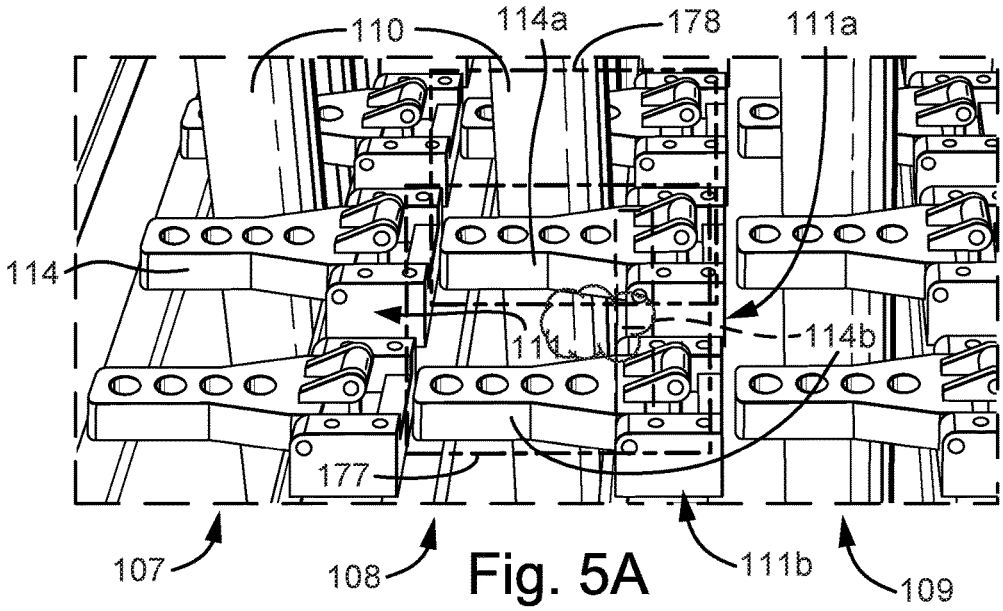
FIG. 5A is an enlarged view of part of the finger board as shown in FIG. 5, with sub-images represented by dot-dash lines.

The finger board 102 is fixed to a derrick 150 at a height approximately 25 m above the rig floor 151. The finger 103 of finger board 102 is shown with latch assemblies 111 spaced therealong at approximately 150 mm intervals. The pipe handling apparatus 140 has a rotatable column 141 rotatable about a vertical axis. A motor 142 is used to rotate the rotatable column 141. The rotatable column 141 is arranged on a track 141' at the top of the column and a corresponding track 141" at the bottom of the column in the rig floor 151 to allow the entire column to move along the front of the finger board 103, whilst the column 141 remains vertical. It will be noted that the track 141' is perpendicular to the column and thus the column moves therealong into and out of the page as shown in FIGS. 7A to 7C. An upper pipe handling arm 143 is arranged above the finger board 102. The upper pipe handling arm 143 has a base unit 144 fixed to the rotatable column 141. An arm 145 has an upper end pivotally connected to a dolly 146 which is controllably slidable along a vertical track 147 fixed to the rotatable column 141 above the base unit 144. A lower end of arm 145 has a pipe gripper 148 pivotally connected thereto. A supporting arm 149 is pivotally connected at an upper end to a middle of the arm 145 and at the other end pivotally connected to the base 144. Upon activation by a control system (not shown), the dolly moves up and down the vertical track to move the pipe gripper 148 towards and away from the rotatable column 141. The camera 101 is arranged on the base unit 144 with a field of vision between dot-dashed lines 152 and 153, looking along the length of the fingers, as shown in FIG. 5.

A second finger board 154 is fixed to the derrick 150 at a height approximately 25 m above rig floor 151. The second finger board is similar to the finger board 102, having fingers 155 and latch assemblies 156 which are similar or identical to the fingers 103-106 and latch assemblies 111. A third finger board 157 is fixed to the derrick 150 at a height approximately 18 m above rig floor 151. The third finger board 157 is similar to the finger board 102, having fingers 158 and latch assemblies 159 which are similar or identical to the fingers 103-106 and latch assemblies 111. A lower pipe handling arm 160 is generally similar to the upper pipe handling arm 143 having a base unit 161 fixed to the rotatable column 141. An arm 162 has an upper end pivotally connected to a dolly 163 which is controllably slidable along a vertical track 164 fixed to the rotatable column 141 above the base unit 161. A lower end of arm 162 has a pipe gripper 165 pivotally connected thereto. A supporting arm 166 is pivotally connected at an upper end to a middle of the arm 162 and at the other end pivotally connected to the base unit 161. Upon activation by a control system (not shown), the dolly 163 moves up and down the vertical track 164 to move the pipe gripper 165 towards and away from the rotatable column 141. Two cameras 167 and 168 are fixed to a bottom of the base unit 163. The second finger board camera 167 has a field of vision between dot-dashed lines 169 and 170. The third finger board camera 168 has a field of vision between dot-dashed lines 171' and 172.

A fourth finger board 171 is fixed to the derrick 150 at a height approximately 8 m above rig floor 151. The fourth finger board 171 is similar to the finger board 102, having fingers 172 and latches 173 which are similar or identical to the fingers 103-106 and latch assemblies 111.

A fourth finger board camera 174 is fixed to the rotatable column 141. The fourth finger board camera 174 has a field of vision between dot-dashed lines 175 and 176 looking along the length of the fingers 172'.

For each of the finger boards 102, 154, 157, and 171, the latch 114 of respective latch assemblies 111, 156, 159, and 173 is optionally red, the fingers 102 to 106 yellow and the drill pipe 110 gun metal grey such that the colours contrast.

The cameras 27, 28, 101, 167, 168, 174 may comprise a CCD or CMOS having colour imaging, a global shutter and a dynamic range of more than 50 db, an angle of view of between 30 and 40 degrees, preferably not a fish eye lense, have a frame rate of seven frames per second and a fixed focal length.

In use, the pipe handling apparatus 140 is controlled by an operator in a control room following a set of steps or by a master control computer following a set of preprogrammed steps to place a stand of drill pipe 110 in the finger rack 139 from a mouse hole or well centre (not shown). The steps comprise the pipe handling apparatus 140 moving along tracks 141',141" to a predetermined point near the mouse-hole or well centre. The pipe handling arms 143 and 160 are activated to move the pipe grippers 148 and 165 away from the rotating column 141 to engage the stand of drill pipe 110 in the mouse hole or well centre. The pipe grippers 148 and 165 are activated to grip the stand of drill pipe. Rollers (not shown) in the pipe grippers 148 and 165 are activated to lift the stand of drill pipe out of the mouse hole clear of the rig floor 151, if required. The pipe grippers 148 and 165 are moved towards the rotating column 141 together with the stand of drill pipe. The pipe handling apparatus 140 is driven along the track 141', 141" to a predetermined position in front of the finger rack 139, for example in front of slot 108. The master control computer automatically activates latch assemblies 111, 156, 159, and 173 and corresponding latches 114 in finger boards 102, 154, 157 and 171 to move to an open position to allow the stand of drill pipe 110 to enter space 108*s* in slot 108 between latches 114*a* and 114*b* (FIG. 5). In use, a respective double acting pneumatic ram 123 is activated to move each respective latch 114 between a closed and open position. The camera 101 is controlled by the master control computer to capture at least one image of the latch assemblies along slot 108. The camera 101 is located on a base unit 144 of the pipe handling apparatus 140 and thus conveniently in line with slot 108. A representation of the image captured by camera 101 is shown in FIG. 5. Simultaneously, cameras 167, 168 and 174 are controlled by the master control computer to capture at least one image of the corresponding latches in finger boards 154, 157 and 171. The master control computer analyses the at least one image from each camera 101, 167, 168 and 174. The master control computer analyses the image and determines if all of the relevant latches are in the image. This may be carried out by comparing the image with a preloaded known image. The master control computer also assesses which of the latches should be open, which is in the present case that all latches should be in the closed position except for latch 114*b* (FIG. 5). The image is broken up into sub images 177 and 178 as shown in FIG. 5A, in which the sub-images 177 and 178 are defined by dot-dash lines. The master control computer analyses the sub images 177 and 178 to look for indications which are indicative of the latch 114*a* of the latch assembly 111*a* and latch 114*b* of latch assembly 111*b* being in an open or closed position. The master control computer looks for indications, such as a contrast in colour around features such as around the latch assemblies 111 when in a horizontal and vertical positions. A light may be provided in line with the camera 101 to improve such a contrast. Once the master control computer has established the positions of the latches 114*a* and 114*b*, the master control computer allows or disallows the pipe handling apparatus 140 to move the stand of drill pipe 110 into slot 108 by moving the pipe grippers 148 and 165 away from the rotatable column 141 on arms 145 and 162 moving the stand of drill pipe into the slot 108. In this case, latch 114*b* is concluded by the master computer control system to be in a closed position, when it should be in an open position. Thus the master control computer system disallows the pipe handling apparatus 140 from moving the stand of drill pipe to enter space 108*s*.

A reverse procedure is carried out for removing a stand of drill pipe from the finger rack 139.

During the service life of the finger rack 139, the colour of the latches 114 and the fingers 103 to 106 and the colour of the drill pipe 110 will change and become marked and have indents from collisions. Furthermore dirt and mud will obscure colour and change the outline of the latch. Thus the master control computer is programmed with an algorithm to ignore small differences and to look for dramatic differences in outline, such as the overall outline of a profile of the latch is an open position and closed position.

It should be noted that the first, second, third and fourth finger boards 102, 154, 157, and 171 may have identical arrangement of fingers and latches to accommodate stands of drill pipe. However, the finger boards may have different arrangements of fingers and latches to accommodate casing, liner, downhole tools, production tubulars, risers, and other types of pipes. For example, the third and fourth finger boards may have additional fingers than the first and second finger boards, which additional fingers are spaced at wide spacings to accommodate large diameter casing and conductor pipe.

Referring to FIGS. 8 to 11, there is shown a third embodiment of the invention, comprising part of a finger board 200. The finger board 200 comprises fingers 201 to 205 fixed at a back end to a derrick or other rig structure 250 and have open front ends defining slots 201' to 204'. The fingers 201 to 205 are spaced to define slots 201' to 205' to receive casing (not shown). Each finger 201 to 205 is provided with nine latch assemblies 206, with adjacent latch assemblies 206 spaced along the length of the fingers 201 to 205 to define a space for each casing. The latch assemblies 206 are generally similar to the latch assemblies 111, save for the latch 207 which is of a different shape and size to the latch 114. The latch 207 has a different pattern of holes 207' and the holes 207' are of triangular shape. The latch 207 is optionally red, the fingers 201 to 205 yellow and the casing gun metal grey such that the colours contrast.

A camera 208 is arranged on a camera carriage 209 on a toothed track 210 behind and above the back of the fingers 201 to 205. The toothed track 210 extends the width of the finger board 200 and approximately 1 m above a horizontal plane defined by the top of the fingers 201 to 205. The camera is angled downwardly to obtain a field of vision indicated by the dot-dashed lines 211 and 212. The camera carriage 209 has a drive motor 213 having a toothed wheel 214 for engaging toothed track 210 to drive the camera carriage 209 therealong. A connector block 215 provides a connection between communication and power lines (not shown) and the camera 208 and drive motor 213. The drive motor 213 may be an X-proof electric motor or may be a hydraulic motor driven from a hydraulic supply hose (not shown). An image processing unit 216 for the camera 208 is also provided for collecting and storing and sending images to a master control computer (not shown). A chain type cable conveyor 217 is provided to retain cables whilst allowing the camera carriage 209 to traverse along toothed track 210.

In use, a pipe handling apparatus such as the one shown in FIG. 1 or 7A to 7C is controlled by an operator in a control room following a set of steps or by a master control computer following a set of preprogrammed steps to place a section of casing in the pipe rack from a mouse hole or well centre. When the pipe handling apparatus has the stand of casing in front of a slot such as slot 201' of finger board 200, the master control computer automatically activates at least one or a plurality of latch assemblies 206 along finger 201 to move latches 207 to an open position to allow the stand of casing to enter. The camera carriage 209 is activated by the master control computer to move along track 210 so that the camera 208 has a field of view along finger 201. The camera 208 is controlled by the master control computer to capture at least one image of the latch assemblies 206 along slot 201. The master control computer analyses the at least one image to determine if all of the relevant latches 207 are in the image. This may be carried out by comparing the image with a preloaded known image. The master control computer also assesses which of the latches 207 should be open. The image is broken up into sub images each defining an area about the latch assembly 206 and an area about the latch 207 in which the latch 207 moves. The master control computer analyses the sub images to look for indications which are indicative of the latch 207 of the latch assembly 206 being in an open on closed position. The master control computer looks for indications, such as a contrast in colour around features such as around the latch 207 when in a horizontal and vertical positions. A light may be provided on camera carriage 209 to provide light of a designated frequency range in line with the camera 208 to improve such a contrast. Once the master control computer has established if the latch of latch assembly 206 is in an open position or closed position, the master control computer allows or disallows a casing being moved into the slot 201.

If a latch assembly 206 is deemed not to be operating correctly by the master control computer, a notification is sent to the driller or to a designated person who can fix the problem when rig conditions are suitable, as set out below in more detail with respect to a negative health check result. In the meantime, the master control computer deems the slot unusable and will not allow casings or stands of drill pipe to be moved into or out of the finger rack.

The inventors observed that it is beneficial to check the health of the latches of a finger board on a regular basis. The inventors have observed that a finger, such as finger 103 to 106 when having slots 107 to 109 empty of stands of drill pipe 110 and of other pipe, should have the latches 114 health checked. The master computer system sends the pipe handling apparatus 140 to the empty finger 103 to 106 and activates one, some or all of the latches 114 to move to an open position. The camera 101 captures a health check image and sends the health check image to the master control computer. The image is processed in the same way as for the confirmation procedure described above to confirm if the one, some or all of the latches are in the open position. The master control computer commands the one, some or all of the latches 114 to close. The master control computer commands the camera 101 to capture another health check image. The image is processed in the same way as for the confirmation procedure described above to confirm if the one, some or all of the latches are in the closed position. If one or more of the latches 114 is not in the correct position, a negative health check command is sent to the master control computer.

In another health check embodiment, a 3D realtime model of the latch assemblies along each finger will be compared to the original 3D model of the latch assemblies along each finger and will be used to check for deviations and abnormalities as the health check.

A hierarchical computer control system such as the one disclosed in WO 2004/012040 can be used to process the negative health check result to inform the correct person to fix the problem. The problem can then be fixed at the appropriate time when the drilling rig is at a stage of operation when personnel can enter the rig floor safely. In the meantime, the master control computer disallows the slot from being used.

The cameras 27, 28, 101, 167, 168, 174 may be of a high definition cctv grey scale or colour camera. Optionally, they may be provided with a distance measuring device, such as a laser so that different parts of an image are provided with a distance measurement from the camera, which facilitates differentiation between latch assemblies.

The cameras 27, 28, 101, 167, 168, 174 may optionally be range imaging cameras used to create a three dimensional representation of the latch assemblies along the finger. The camera may use a laser reflection or sonar reflection to determine distance from the camera to obtain relative differences and thus build up a three dimensional range image.

The range imaging cameras may be a stereo triangulation type in which two spaced cameras are pointed to the same spot on the rig for determining the depth to points in the scene. The two spaced cameras may be located on the same camera carriage or pipe handling apparatus or arm.

The range imaging camera may be a sheet of light triangulation type wherein the zone is illuminated with a sheet of light which creates a reflected line as seen from the light source. From any point out of the plane of the sheet the line will typically appear as a curve, the exact shape of which depends both on the distance between the observer and the light source, and the distance between the light source and the reflected points. By observing the reflected sheet of light using a high resolution camera and knowing the positions and orientations of both camera and light source, it is possible to determine the distances between the reflected points and the light source or camera. By moving either the light source (and normally also the camera) or the scene in front of the camera, a sequence of depth profiles of the scene can be generated. These can be represented as a 2D range image.

The range imaging camera may be a structured light type, wherein the zone is flooded with a specially designed light pattern, structured light, depth can be determined using only a single image of the reflected light. The structured light can be in the form of horizontal and vertical lines, points or checker board patterns.

Figure 12:
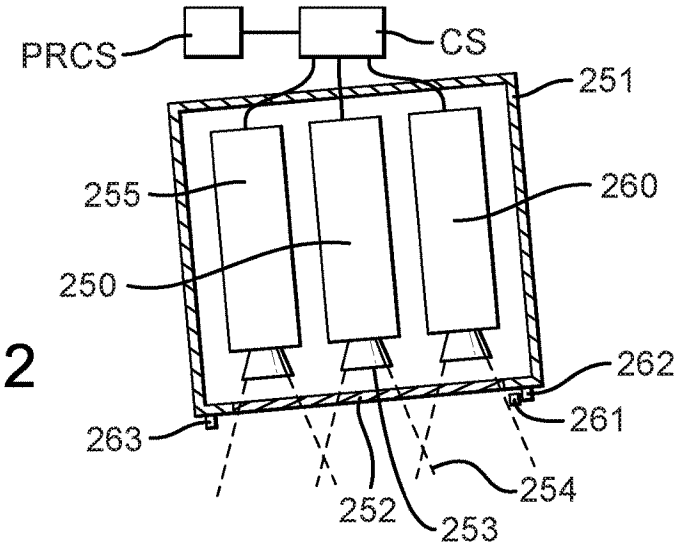
FIG. 12 is a schematic view of a housing enclosing inter alia a camera.
Figure 11:
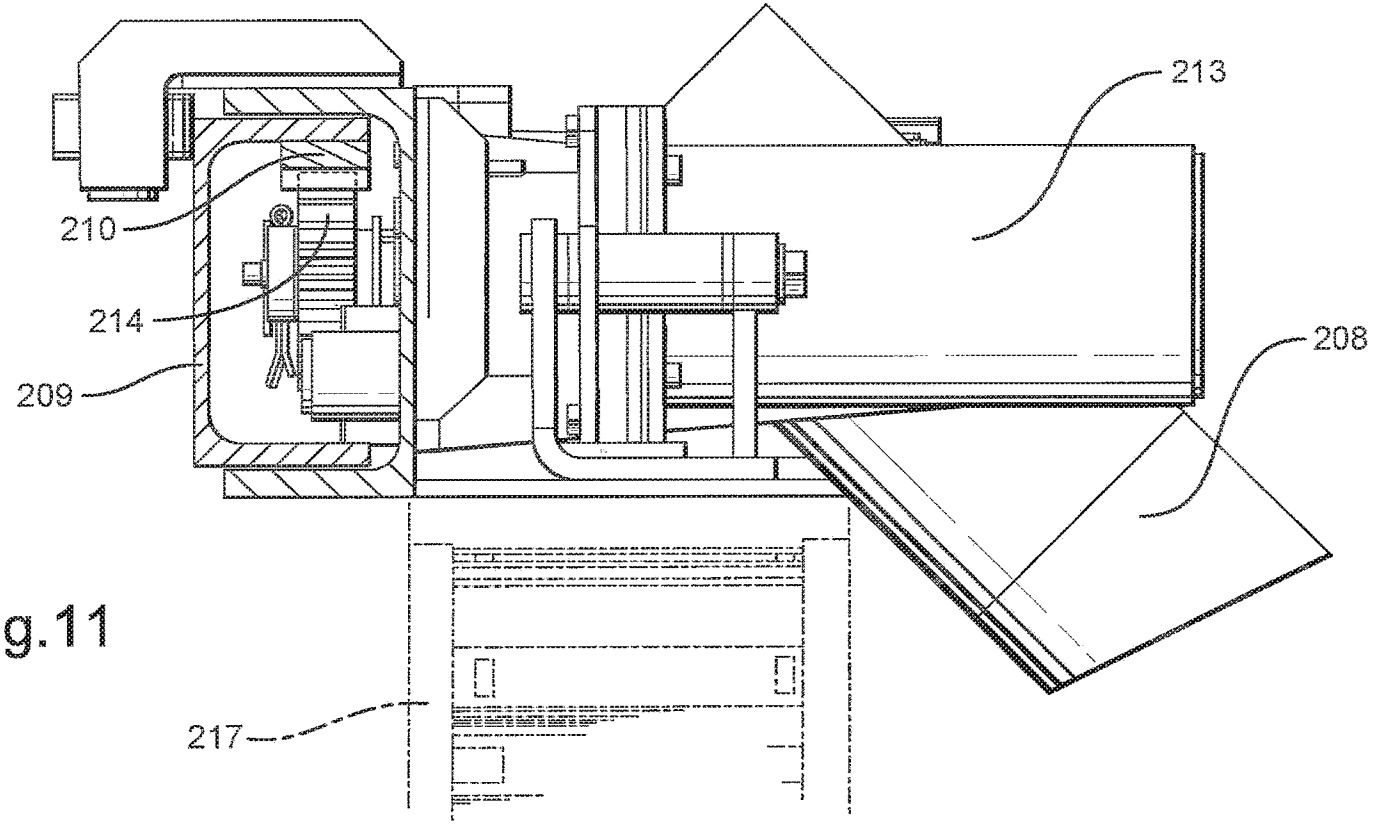
FIG. 11 is a side schematic view of the part of the apparatus shown in FIG. 10, partly in section.

The range imaging camera may be a time-of-flight technique, wherein a light pulse is used to, optionally with the entire zone captured with a single light pulse, although point-by-point rotating laser beam is an option. Time-of-flight cameras capture the whole zone in three dimensions with a dedicated image sensor, and therefore have no need for moving parts. A time-of-flight laser radar with a fast gating intensified CCD camera may achieve millimeter depth resolution. With this technique a short laser pulse illuminates the zone, and the intensified CCD camera opens its high speed shutter only for a few hundred picoseconds. The 3D information is calculated from a 2D image series that was gathered with increasing delay between the laser pulse and the shutter opening. Referring to FIG. 12, there is shown a camera 250, such as any one or more of the cameras 27, 28, 101, 167, 168, 174, 301, 301', and 301", enclosed in a housing 251. The housing 251 is optionally sealed to inhibit water ingress. The housing 251 has a window 252 through which the camera 250 is directed. The window 252 is optionally made of a material which has minimal resistance to the wavelengths of light received by lens 253 of the camera 250 and optionally does not inhibit the field of view 254. The housing 251 optionally also encloses an infrared camera 255 which looks for an infrared marker adhered or otherwise attached to a latch (such as any latch disclosed herein). An example of an infrared marker is an infrared reflector. The infrared camera relays the image to a computer system which calculates positional data of the detected infrared marker. An open, closed or intermediate position of the latch is calculated from the positional data. Infrared cameras will not work in all weather conditions nor in all light conditions and thus is optionally used to confirm the results obtained by the camera 250. The visible light camera and the infrared cameras thus complement each other.

A light source 260 is also enclosed in the housing and is directed through the window 252 in substantially the same direction as the camera 250 in order to illuminate the field of view 254 of the camera 250. The light source 260 may provide a light across the same frequency spectrum as that of the camera 250. Optionally, the light source 260 is more focused and only illuminates a part of the field of view 254 of the camera 250. The light source 260 optionally illuminates a latch 314 (FIGS. 14 and 15) in the field of view 254, such that a light intensity of at least 350 LUX is maintained thereon or there at. The window 252 may be provided with a wiper 261, a wiper motor 262 and a rain sensor 263 for keeping the window 252 clean and clear of dirt and rain spots.

Figure 13:
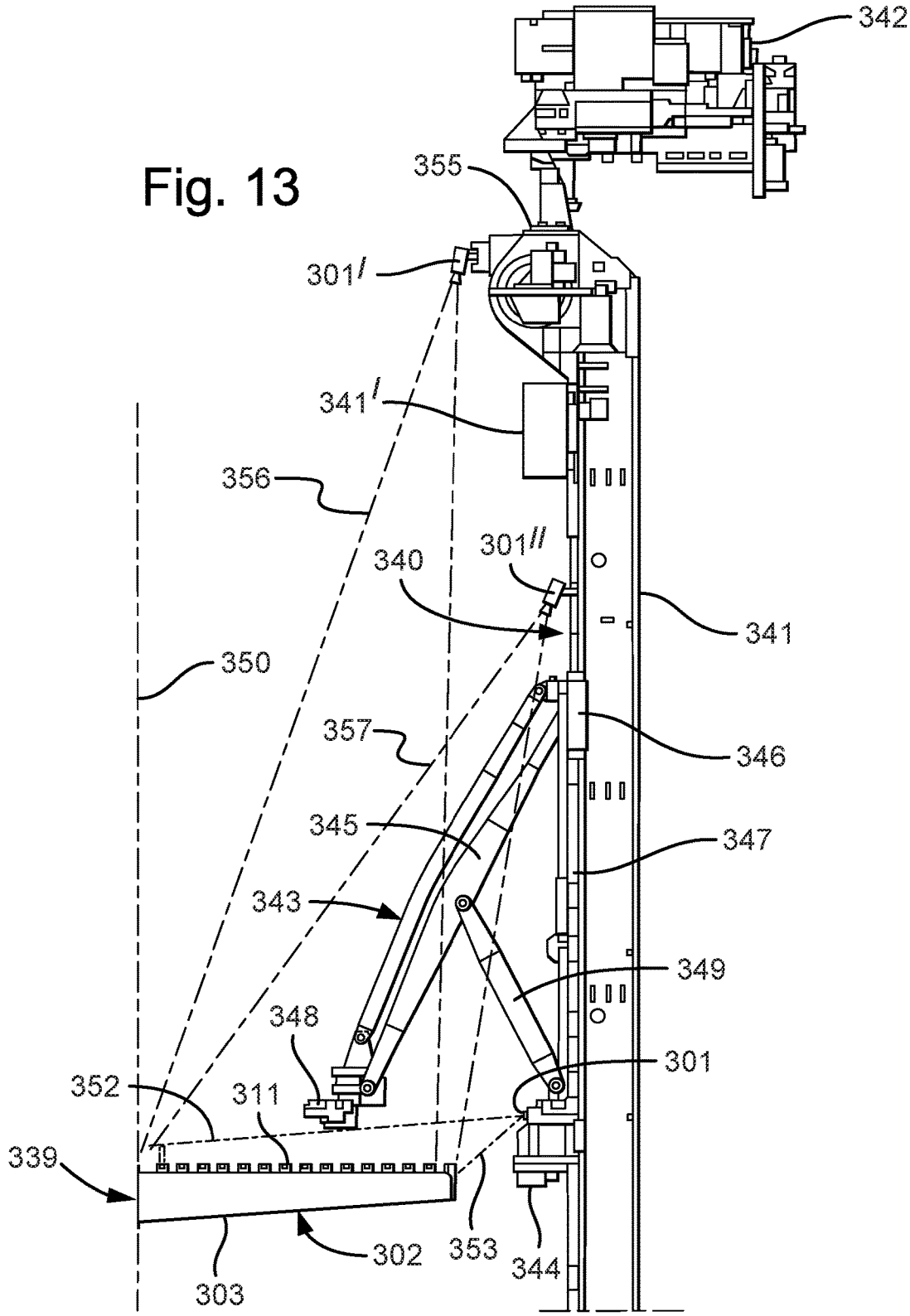
FIG. 13 is a side view of the finger board shown in FIG. 4 in a derrick with a pipe handling apparatus in accordance with the present invention, without stands of drill pipe therein.

Referring now to FIG. 13, there is shown a pipe handling apparatus 340, known as a column racker and a finger rack 339. The finger rack 339 comprises at least one finger board 302.

Figure 14:
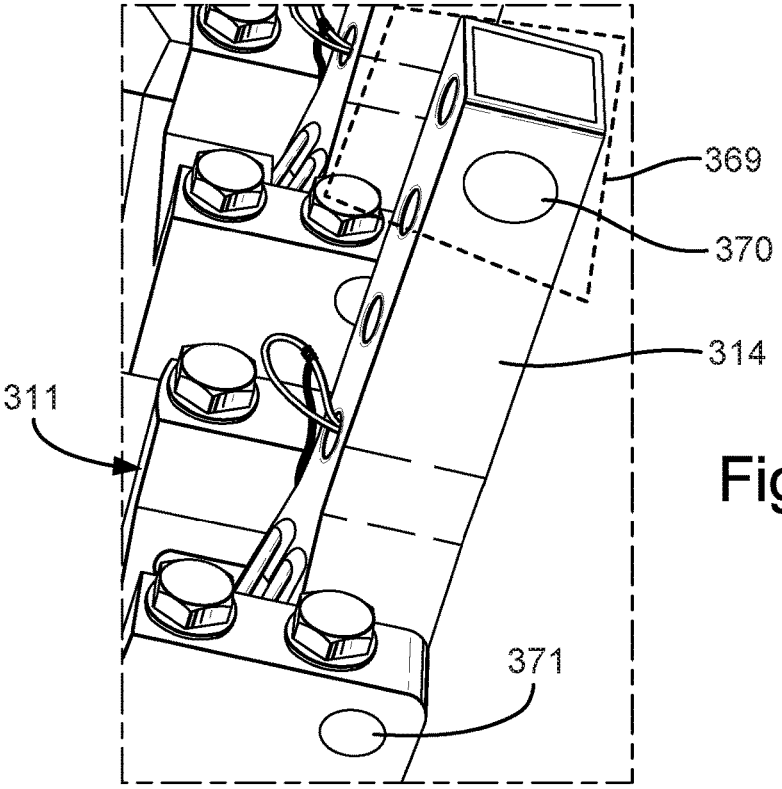
FIG. 14 is a view as identified by the system of the invention from an image obtained by any of the cameras disclosed herein, the view showing a latch in an open position.
Figure 15:
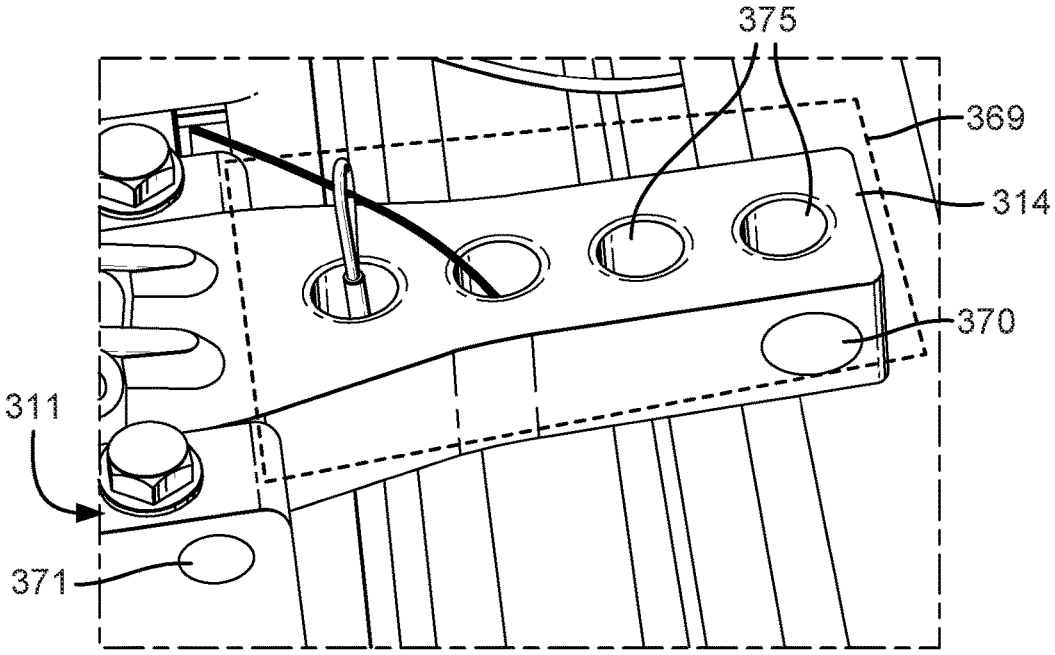
FIG. 15 is a view as identified by the system of the invention from an image obtained by any of the cameras disclosed herein, the view showing a latch in a closed position.

The finger board 302 is fixed to a derrick 350 at a height between approximately 8 and 35 m above the rig floor (not shown). A finger 303 of the finger board 302 is shown with latch assemblies 311 spaced therealong at approximately 150 mm intervals. Each latch assembly 311 comprises a latch 314 (FIGS. 14 and 15). The pipe handling apparatus 340 has a rotatable column 341 rotatable about a vertical axis. A motor 342 is used to rotate the rotatable column 341. The rotatable column 341 is arranged on a track 341' at the top of the column and a corresponding track (not shown) at the bottom of the column in the rig floor to allow the entire column to move along the front of the finger board 303, whilst the column 341 remains vertical. It will be noted that the track 341' is perpendicular to the column and thus the column moves therealong into and out of the page as shown in FIG. 13. An upper pipe handling arm 343 is arranged above the finger board 302. The upper pipe handling arm 343 has a base unit 344 fixed to the rotatable column 341. An arm 345 has an upper end pivotally connected to a dolly 346 which is controllably slidable along a vertical track 347 fixed to the rotatable column 341 above the base unit 344. A lower end of arm 345 has a pipe gripper 348 pivotally connected thereto. A supporting arm 349 is pivotally connected at an upper end to a middle of the arm 345 and at the other end pivotally connected to the base 344. Upon activation by a control system CS, the dolly moves up and down the vertical track to move the pipe gripper 348 towards and away from the rotatable column 341. Camera 301 is arranged on the base unit 344 with a field of vision between dot-dashed lines 352 and 353, looking along the length of the fingers 303, similar to that shown in FIG. 5.

A second camera 301' is located at a top of the column 341 on a motor housing 355 fixed to the column 341, optionally placed over the track 341'. The second camera 301' is thus in front of the fingerboard 302 and in front of any pipe (not shown) held in pipe gripper 348 when the pipe gripper moves the pipe into and out from the slots in the fingerboard 302. The second camera 301' is directed to have a fixed field of view shown as dashed-dot lines 356. The second camera 301' will thus be coupled to the column 341 and move therewith, so that it will be in position at each active row of latch assemblies 311 at all times. Alternatively or additionally the second camera 301' may be mounted on a rotation means so that the second camera 301' can rotate in a horizontal plane and optionally in a vertical plane or both to maintain or change the field of view 356.

In operation, the column 340 moves along track 341' in front of a predetermined row of latch assemblies 311 in fingers 303. During a set-back pipe operation the second camera 301' feeds back images to the control system CS, which interprets the image for the following:

1. A ghost pipe check, whilst the arm 345 is retracted and latches 314 remain closed: an image is obtained from the camera 301' and transferred to the control system CS. The image is processed and a generated feedback signal from the control system CS is sent to the pipe racker control system PRCS, which will be either: all clear; or set ghost pipe flag. If the all clear signal is passed from the control system CS to the pipe racker control system PRCS, then the PRCS activates the required latches 314 to open. If a ghost pipe is flagged, this signal is sent to the PRCS. The PRCS does not allow the latches 314 to open and optionally alerts an operator that there is an unexpected pipe or other object in the fingers.

2. Ready to set-back in the predetermined row of latch assemblies 311 between fingers 303 of the at least one fingerboard 302, with the arm 345 still retracted: an image is obtained from the camera 301' and transferred to the control system CS. The image is processed and a generated feedback signal from the control system CS is sent to the pipe racker control system PRCS, which will be either: confirm latches opened; or set latch error flag. If the latches 314 are confirmed open, the pipe racker control system PRCS sets arm 345 in motion to set-back a pipe (not shown) and closes latches 314.

3. Finish: an image is obtained from the camera 301' and transferred to the control system CS. The image is processed and a generated feedback signal from the control system CS is sent to the pipe racker control system PRCS, which will be either: confirm latches closed; or set latch error flag. In the former, the PRCS will allow the pipe gripper 348 to release the pipe and to allow the pipe racker to continue with the next operation, such as to go to well-centre to pick up another pipe. In the latter, the pipe gripper 348 will not be allowed to release the pipe and alert an operator and set an algorithm in motion to disallow any operation in that set of latches 314.

During a pulling operation (getting a pipe) the second camera 301' feeds back to the computer system:

1. Before start—a ghost pipe check is carried out, whilst the arm 345 is retracted and latches 314 remain closed. An image is obtained from the camera 301' and transferred to the control system CS. The image is processed and a generated feedback signal from the control system CS is sent to the pipe racker control system PRCS, which will be either: all clear; or set ghost pipe flag. If the all clear signal is passed from the control system CS to the pipe racker control system PRCS, then the PRCS activates the arm 348 to move offer pipe gripper 348 up to an expected pipe. If a ghost pipe is flagged, this signal is sent to the PRCS. The PRCS does not allow the pipe arm 348 to move and optionally alerts an operator that there is an unexpected pipe or other object in the fingers.

2. Ready to get a pipe from the at least one fingerboard 302, with the pipe gripper 348 offered up to and gripping or otherwise engaging the pipe (not shown) in the fingers 303 the latches 314 are commanded open by the PRCS: the feedback signal from the control system CS to the pipe racker control system PRCS will be either: confirm latches open; or set latch error flag. If the all clear signal is passed from the control system CS to the pipe racker control system PRCS, then the PRCS activates the arm 348 to move offer pipe gripper 348 towards the column, pulling the pipe therewith and the latches 314 are commanded to close. If a set latch error flag is generated by the control system, this signal is sent to the PRCS. The PRCS does not allow the pipe arm 348 to move and optionally alerts an operator that there is an unexpected pipe or other object in the fingers.

3. Finished, with the arm 348 retracted and latches 314 closed in the at least one fingerboard, the control system processes a new image taken by the camera 301' to: confirm latches closed; or set latch error flag.

In the above described steps, the ghost pipe check may also include an unregistered pipe check.

One camera may be used to obtain an image to carry out each of the above steps, although it is optional to have a separate camera for each finger board. It is also preferable to have a second camera for added redundancy so that if the first camera fails the second can takeover. It is also preferable to have a second camera and a second algorithm for checking each result of the first. Alternatively, a separate camera may be provided to take images for each step or a selection of steps as set out above. A further camera 301" having a field of view shown as dashed-dot lines 357 is located on the column below the track 341'. This camera is used for redundancy, in case of camera failure or used in conjunction with another algorithm to confirm or deny results of the other cameras 301 and 301'.

If there is a second fingerboard below the first finger board 302, similar to the fingerboard 154 shown in FIG. 7B, it is possible for the camera 301' to have a field of view on to the latches thereof. However, this can only determine that the latches on the fingerboard 154 are open when they should be. It is thus preferable to have a separate camera for the any second or third fingerboards below the first.

The cameras 27, 101, 167, 168, 174 may comprise a CCD or CMOS having colour imaging, a global shutter and a dynamic range of more than 50 db, an angle of view of between 30 and 40 degrees, preferably not a fish eye lense, have a frame rate of at least seven frames per second and a fixed focal length.

Figure 4:
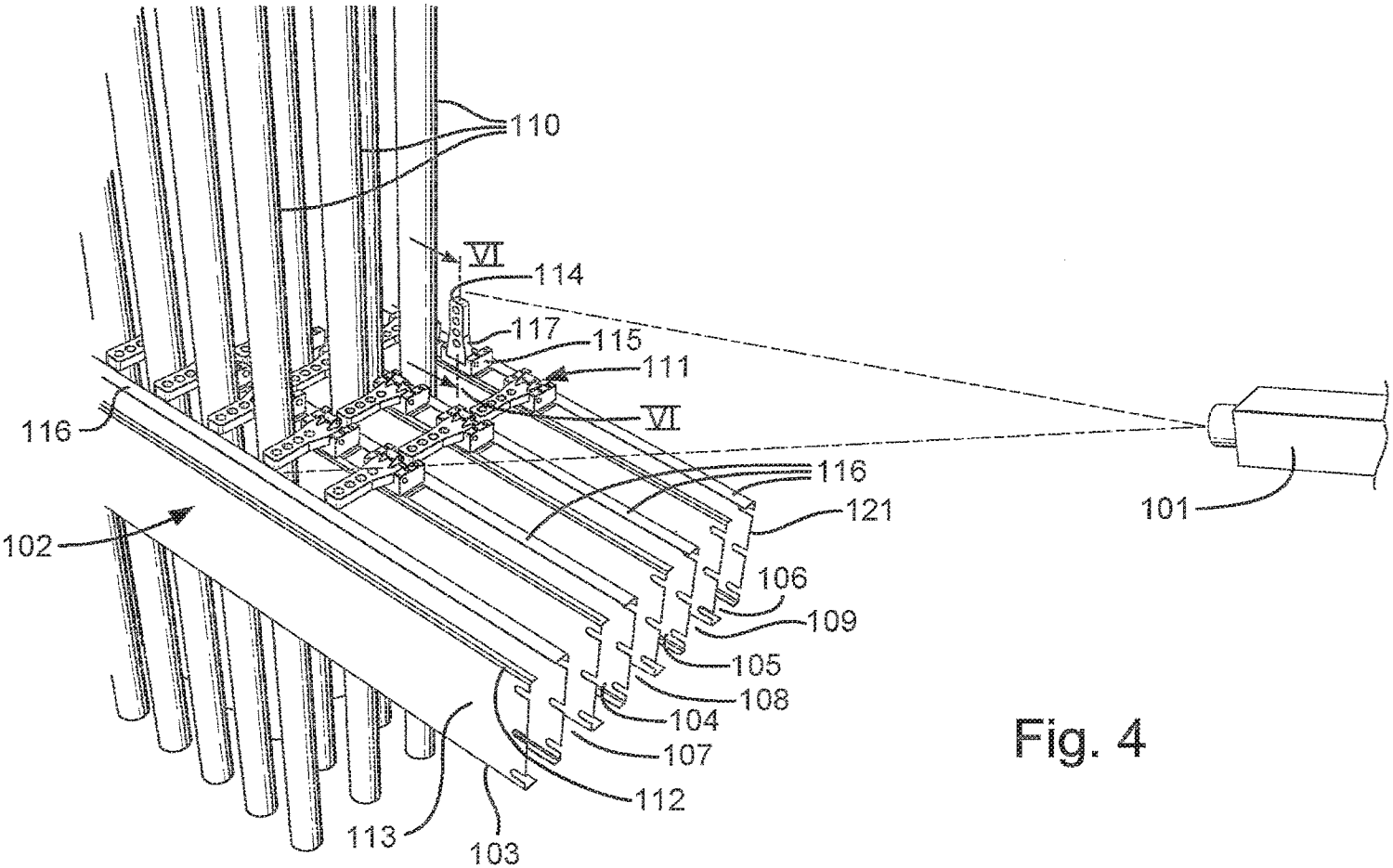
FIG. 4 is a perspective view of a second embodiment of the invention, showing a part of a finger board and camera arrangement of the invention, in a first stage of operation with a multiplicity of stands of drill pipe.

Each latch 314, as shown in FIGS. 14 and 15 is generally similar to each latch 114 shown in FIGS. 4 to 6, with the additional feature of a marker 370. The latch 314 may be any colour, and may be red. The marker 370 is optionally made from a reflective material, such as that provided by 3M Corporation under the Scotchlite™ brand reflective material type 3150A SOLAS Grade Pressure Sensitive Adhesive Film Silver in white or blue, which also relects infrared. The fingers 303 may be painted yellow and the pipe, generally gun metal grey such that the colours contrast. The marker 370 is optionally in the form of a circle, but may be any suitable shape, such as a square, triangle or polygon. Optionally, the marker 370 is of a distinctive size and shape which is easily differentiated from other features within the field of view 352/353, 356, 357 of the cameras 301, 301', 301" respectively.

Referring to FIG. 14, there is shown a part of the image in the field of view of the cameras 301, 301' or 301". The control system CS checks to see if the latch 314 of the latch assembly 311 is indeed open. The control system CS optionally analyses the image to look for the absolute position or relative position of the marker 370, which gives an indication of which latch 314 of the multiplicity of latches 314 the control system CS is looking at and which finger 303 the latch 314 is on (other fingers are not shown in FIG. 13, but are similar to the fingers 102 to 106 shown in FIG. 5). Once the marker 370 is located, an area 369 is defined thereabout to look for other features of the latch 314. Optionally, the control system analyses the image to look for a relative position of the marker 370 relative to another feature of the latch 314. Such another feature of the latch 314 is an outline of the latch. The outline of the latch appears as a strong colour contrast in the form of a rectangular outline. If the marker 370 appears at the top of the long side of the rectangular outline of the latch 314, the latch 314 is open. If the marker 370 does not appear at the top of the long side of the rectangular outline of the latch 314, the latch is closed or partially closed. Another possible feature of the latch 314 used to determine the relative position of the marker 370 is the hinge pin 371, which may also be provided with a reflective marker.

Referring to FIG. 15, there is shown a part of the image in the field of view of the camera 301, 301' or 301". The control system CS checks to see if the latch 314 is indeed closed. The control system CS optionally analyses the image to look for the absolute position or relative position of the holes 375, which gives an indication of which latch 314 it is along the find 303. The holes are generally circular, although the image portrays the circular holes as ellipses, due to relative position of the camera 301, 301', 301". The control system CS thus analyses the image to look for ellipses. Optionally, the control system analyses the image to look for a row of ellipses. If the image comprises a row of ellipses, the latch is confirmed as lying in a closed position. Another possible feature of the latch to confirm the latch is closed is the relative position of the row of ellipses against an outline of the latch 314.

The invention claimed is:

1. A system for placing and removing pipe from a finger rack of a drilling rig, the system comprising:

a pipe handling apparatus;

a finger rack having at least one finger board, said at least one finger board having at least two fingers defining a slot and a multiplicity of latches arranged therebetween defining a space for a pipe, each latch of the multiplicity of latches selectively movable between an open position and a closed position; and a camera having a plurality of latches of said multiplicity of latches in a field of view, wherein the camera is adapted to capture an image of said a plurality of latches and send said image to a master control computer that is adapted to define a sub-image of an area about one latch, said area being sufficient to cover the one latch in an open position and a closed position, said master control computer being further adapted to analyse said image for details indicative of one of the plurality of latches being in an open position or a closed position, to conclude the one latch is in an open position or a closed position, and to allow or disallow a pipe handling apparatus to place or remove a pipe in the finger rack based on said conclusion.

2. A system in accordance with claim 1, wherein the at least one camera is a high definition cctv camera which captures the image.

3. A system in accordance with claim 1, wherein the at least one camera is a range imaging camera to capture the image.

4. A system in accordance with claim 1, wherein the at least one camera is arranged on said pipe handling apparatus.

5. A system in accordance with claim 4, wherein the pipe handling apparatus comprises a pipe handling arm with a pipe gripping apparatus for gripping a pipe, and a base fixed to a column, the at least one camera fixed to said base.

6. A system in accordance with claim 1, wherein the at least one finger board is arranged in a derrick and the at least one camera is arranged on a part of said derrick in front of and above said finger board.

7. A system in accordance with claim 1, wherein the at least one camera is arranged at the back and above the finger board.

8. A system in accordance with claim 6, wherein the at least one camera is arranged on a track.

9. A system in accordance with claim 1, wherein said master control computer is adapted to analyse said image for details indicative of the at least one latch being in an open position or a closed position by analysing a contrast about said latch.

10. A system in accordance with claim 1, wherein the pipe handling apparatus is controlled by a pipe handling control computer that is adapted to find a pipe in said finger board, to remove the pipe from the finger board and to convey the pipe to well centre, the master control computer being adapted to instruct said pipe handling computer to allow or disallow the pipe handling apparatus to place or remove a pipe in the finger rack based on said conclusion as to whether the one latch is in an open position or a closed position.

11. A system in accordance with claim 1, wherein the at least one camera is adapted to obtain at least one further image of the one latch after obtaining said image, said master control computer being adapted to analyse said at least one further image to confirm or deny said conclusion.

12. A system as claimed in claim 1, wherein each of said multiplicity of latches has a hole therethrough, and wherein the master control computer is adapted to look for ellipses on said latch.

13. A system as claimed in claim 1, wherein said one latch comprises a marker.

14. A system as claimed in claim 13, wherein said master control computer is adapted to look for said marker on said one latch.

15. A system as claimed in claim 1, wherein said at least one camera is adapted to capture an image of said slot of said finger rack and said master control computer is adapted to look for a ghost pipe.

16. A system as claimed in claim 1, wherein said at least one camera is adapted to capture an image of said slot of said finger rack and said master control computer is adapted to look for an unregistered pipe.

17. A system in accordance with claim 1, wherein the pipe is one of: a joint of drill pipe; a stand of drill pipe; a section of casing; stand of drill pipe having a downhole tool therein or connected thereto, and a Bottom Hole Assembly or part thereof.

18. A method for placing and removing pipe from a finger rack of a drilling rig comprising a rig floor, a derrick, a pipe handling apparatus and a finger rack having at least one finger board, said at least one finger board having at least two fingers defining a slot and a multiplicity of latches arranged therebetween defining a space for a pipe, each latch of the multiplicity of latches selectively movable between an open position and a closed position, the drilling rig further comprising a camera having a plurality of latches of said multiplicity of latches in a field of view, the method comprising the steps of:

capturing an image of said plurality of latches with said camera;

sending said image to a master control computer;

defining a sub-image of an area about one latch with said master control computer, said area being sufficient to cover the one latch in an open position and a closed position;

analysing said image with said master control computer for details indicative of one of the plurality of latches being in an open position or a closed position;

concluding the one latch to be in an open position or a closed position; and allowing or disallowing a pipe handling apparatus to place or remove a pipe in the finger rack based on said conclusion.

19. A drilling rig, comprising:

having a rig floor;

a derrick;

a pipe handling apparatus;

at least one finger board having at least two fingers defining a slot and a multiplicity of latches arranged therebetween defining a space for a pipe, each latch of the multiplicity of latches selectively movable between an open position and a closed position; and a camera having a plurality of latches of said multiplicity of latches in a field of view, wherein said camera is positioned on said pipe handling apparatus and adapted to capture an image of said plurality of latches and send said image to a master control computer that is adapted to define a sub-image of an area about one latch, said area being sufficient to cover the one latch in an open position and a closed position, said master control computer being further adapted to analyse said image for details indicative of one of the plurality of latches being in an open position or a closed position, to conclude the one latch is in an open position or a closed position, and to allow or disallow said pipe handling apparatus to place or remove a pipe in the finger board based on said conclusion.

20. A system for monitoring the health of a multiplicity of latches in a finger board of a drilling rig, the system comprising:

a drilling rig having a pipe handling apparatus and at least one finger board having at least two fingers defining a slot and a multiplicity of latches arranged therebetween defining a space for a pipe, each latch of the multiplicity of latches selectively movable between an open position and a closed position and a latch controller for controlling said latches between the open position and the closed position; and a camera having a plurality of latches of said multiplicity of latches in a field of view, wherein said camera is adapted to capture an image of said plurality of latches and send said image to a master control computer that is adapted to define a sub-image of an area about one latch, said area being sufficient to cover the one latch in an open position and a closed position, said master control computer being further adapted to analyse said image for details indicative of one of the plurality of latches being in an open position or a closed position, to conclude the one latch is in an open position or a closed position, and to receive a control information in a data packet from the latch controller, the control information data packet comprising information as whether said one latch has been controlled to be in an open position or a closed position, the master control computer being further adapted and to perform a comparison of the said control information with the conclusion obtained from the image captured by the at least one camera and assessing the health of the one latch based on said comparison.

21. A system in accordance with claim 20, wherein the latch controller is incorporated into a pipe handling computer.

22. A system in accordance with claim 20, wherein if the assessment of the health of the one latch is unhealthy, the master control computer is adapted to send a message to a display indicating that the one latch is unhealthy.

23. A system in accordance with claim 20, wherein if the assessment of the health of the one latch is unhealthy, the master control computer is adapted to send a message to a repair operative.

24. A system in accordance with claim 23, wherein said master control computer has a pre-loaded memory comprising information about at least one of: said one latch; said finger board; and said pipe handling apparatus.

25. A system in accordance with claim 24, wherein said message includes at least one of said information, a copy of said image, or a copy of a further image captured by said at least one camera.

26. A system as claimed in claim 20, wherein the health of a multiplicity of latches is monitored during a commissioning procedure.

27. A system as claimed in claim 20, wherein the health of a multiplicity of latches is monitored during operation of the drilling rig.

* * * * *